US012808633B2

(12) United States Patent
Meissen et al.

(10) Patent No.: US 12,808,633 B2
(45) Date of Patent: Nov. 24, 2026

(54) WEAPON REMOTE SWITCH ASSEMBLY

(71) Applicant: Crimson Trace Corporation, Columbia, MO (US)

(72) Inventors: Tim Meissen, Columbia, MO (US); William A. Planck, Columbia, MO (US); Michael Cottrell, Ashland, MO (US)

(73) Assignee: Crimson Trace Corporation, Columbia, MO (US)

( * ) Notice: Subject to any disclaimer, the term of this patent is extended or adjusted under 35 U.S.C. 154(b) by 0 days.

(21) Appl. No.: 18/778,885

(22) Filed: Jul. 19, 2024

(65) Prior Publication Data

US 2025/0027749 A1 Jan. 23, 2025

Related U.S. Application Data

(60) Provisional application No. 63/514,374, filed on Jul. 19, 2023.

(51) Int. Cl.
*F41G 11/00* (2006.01)
*F41G 1/35* (2006.01)

(52) U.S. Cl.
CPC ..... *F41G 11/003* (2013.01); *F41G 1/35* (2013.01)

(58) Field of Classification Search
CPC ..... F41G 11/003; F41G 11/001; F41G 1/35
USPC ..... 362/110; 42/146
See application file for complete search history.

(56) References Cited

U.S. PATENT DOCUMENTS 252,230 A 1/1882 Ligowsky
1,376,825 A 5/1921 Napier
1,475,713 A 11/1923 Napier
1,663,780 A 3/1928 Spangler
1,979,502 A 11/1934 Sutcliffe
2,078,166 A 4/1937 Schwerin
2,135,603 A 11/1938 Roth
2,436,453 A 2/1948 Schulz
2,531,613 A 11/1950 Darrell
(Continued)

FOREIGN PATENT DOCUMENTS

CN 204240867 U 4/2015
CN 214582808 U 11/2021
(Continued)

OTHER PUBLICATIONS

Surefire; SR07 WeaponLight Switch Remote Dual Switch for WeaponLights; Jun. 4, 2023; https://web.archive.org/web/20230604201138/https://www.surefire.com/sr07-weaponlight-switch/ (Year: 2023).*

(Continued)

*Primary Examiner* — Joshua E Freeman
(74) *Attorney, Agent, or Firm* — Stinson LLP

(57) ABSTRACT

A firearm accessory system and associated components and methods. The firearm accessory system includes a remote switch and a firearm accessory. The remote switch can include a switch assembly and a switch mount. A kit of switch mounts can be provided for selectively forming a remote switch with the switch assembly. The switch mounts of the kit are configured for mounting to different types of firearm connection structure. The switch mounts may be configured to permit installation of the switch assembly thereon without disconnection of a tether from the switch assembly.

20 Claims, 15 Drawing Sheets

(56) References Cited

U.S. PATENT DOCUMENTS 2,548,031 A 4/1951 Leupold
2,626,596 A 1/1953 Lyon
2,666,424 A 1/1954 Foster
2,711,163 A 6/1955 Richardson
2,925,812 A 2/1960 Foster
2,938,977 A 5/1960 Koenig
3,045,351 A 7/1962 Dayton
3,052,772 A 9/1962 Koenig
3,070,082 A 12/1962 Foster
3,093,127 A 6/1963 Starr
3,179,101 A 4/1965 Luebkeman
3,368,542 A 2/1968 Dale
3,533,392 A 10/1970 Luebkeman
3,559,940 A 2/1971 Kruzell
3,579,840 A 5/1971 Heinzel
3,634,680 A 1/1972 Myrah
3,677,257 A 7/1972 Segerkvist
3,710,054 A 1/1973 Koenig
3,722,495 A 3/1973 Hansen
3,739,167 A * 6/1973 Avery ..... F21L 14/00 362/110
3,750,318 A 8/1973 Burris
3,821,945 A 7/1974 Foster
3,826,238 A 7/1974 Hansen
3,923,033 A 12/1975 Laporte et al.
3,937,203 A 2/1976 Riedmueller et al.
3,971,357 A 7/1976 LaPorte et al.
3,979,848 A 9/1976 Ackerman, Jr.
4,005,695 A 2/1977 Alday et al.
4,014,310 A 3/1977 Laporte et al.
4,146,007 A 3/1979 Alday et al.
4,146,008 A 3/1979 Rowlands
4,152,754 A 5/1979 deFilippis et al.
4,230,921 A 10/1980 Wearing et al.
4,273,974 A 6/1981 Miller
4,293,751 A 10/1981 Van Benthuysen et al.
4,293,752 A 10/1981 Koenig
4,300,520 A 11/1981 Laporte et al.
4,319,106 A 3/1982 Armitage
4,463,231 A 7/1984 Cooper et al.
4,481,932 A 11/1984 Olson
4,506,124 A 3/1985 Rose et al.
4,532,388 A 7/1985 Sackmann et al.
4,551,595 A 11/1985 Koenig
4,688,345 A 8/1987 Kilgour
4,697,226 A 9/1987 Verdin
4,706,641 A 11/1987 Cote et al.
4,733,337 A 3/1988 Bieberstein
4,831,996 A 5/1989 Cero
4,858,361 A 8/1989 White
4,934,085 A 6/1990 Lough
4,987,277 A 1/1991 Duhon
5,033,219 A 7/1991 Johnson et al.
5,179,235 A 1/1993 Toole
5,194,007 A 3/1993 Marshall et al.
5,198,600 A 3/1993 E'Nama
5,226,622 A 7/1993 LeAnna
5,237,773 A 8/1993 Claridge
5,279,060 A 1/1994 Watson
5,400,540 A 3/1995 Solinsky et al.
5,403,980 A 4/1995 Eckrich
5,427,380 A 6/1995 Hazard et al.
5,428,915 A 7/1995 King
5,430,967 A 7/1995 Woodman, III et al.
5,435,091 A 7/1995 Toole et al.
5,470,078 A 11/1995 Conlan
5,560,703 A 10/1996 Capps, III
5,570,529 A 11/1996 Amelino
5,581,989 A 12/1996 Mann et al.
5,584,136 A 12/1996 Boland et al.
5,590,484 A 1/1997 Mooney et al.
5,590,486 A 1/1997 Moore
5,618,099 A 4/1997 Brucacher
5,628,555 A 5/1997 Sharrah et al.
5,642,932 A 7/1997 Matthews
5,654,594 A 8/1997 Bjornsen, III et al.
5,669,173 A 9/1997 Rodney, Jr.
5,680,909 A 10/1997 Lofy
5,685,105 A 11/1997 Teetzel
5,706,600 A 1/1998 Toole et al.
5,723,835 A 3/1998 Gilmore
5,758,448 A 6/1998 Thummel
5,784,823 A 7/1998 Chen
D398,410 S 9/1998 Fell et al.
5,826,363 A 10/1998 Olson
5,878,503 A 3/1999 Howe et al.
5,913,669 A 6/1999 Hansen et al.
5,937,839 A 8/1999 Nilsson et al.
5,939,687 A 8/1999 Ellermann
5,941,489 A 8/1999 Fanelli et al.
5,970,969 A 10/1999 Anttila et al.
6,014,830 A 1/2000 Brown et al.
6,023,875 A 2/2000 Fell et al.
6,062,207 A 5/2000 Underhill
6,159,112 A 12/2000 Ciluffo et al.
6,185,854 B1 2/2001 Solinsky et al.
6,230,431 B1 5/2001 Bear
6,276,088 B1 8/2001 Matthews et al.
6,278,237 B1 8/2001 Campos
6,345,464 B1 2/2002 Kim et al.
6,363,648 B1 4/2002 Kranich et al.
6,385,894 B1 5/2002 Podvin
6,392,146 B1 5/2002 Hier et al.
6,392,147 B1 5/2002 Hier et al.
6,418,657 B1 7/2002 Brown
6,421,946 B1 7/2002 LoRocco
6,438,888 B1 8/2002 Lin et al.
6,446,377 B1 9/2002 Hollenbach et al.
6,449,893 B2 9/2002 Spinner
6,513,251 B2 2/2003 Huang et al.
6,526,688 B1 3/2003 Danielson et al.
6,568,118 B1 5/2003 Teetzel
6,571,503 B2 6/2003 Thorpe
6,574,901 B1 6/2003 Solinsky et al.
6,578,311 B2 6/2003 Danielson et al.
6,598,333 B1 7/2003 Randazzo et al.
6,606,813 B1 8/2003 Squire et al.
6,608,264 B1 8/2003 Fouladpour
6,609,321 B2 8/2003 Faifer
6,609,810 B2 8/2003 Kim
6,615,531 B1 9/2003 Holmberg
6,655,069 B2 12/2003 Kim
6,671,991 B1 1/2004 Danielson
6,698,127 B2 3/2004 Weber
6,705,038 B2 3/2004 Davenport et al.
6,722,074 B1 4/2004 Farrell
6,725,594 B2 4/2004 Hines
6,732,987 B2 5/2004 Wooten et al.
6,782,652 B1 8/2004 Erickson
6,851,214 B2 2/2005 Oz
6,874,269 B2 4/2005 Chen et al.
D505,177 S 5/2005 Fell et al.
6,931,668 B2 8/2005 Nelson et al.
6,994,449 B2 2/2006 Kim
7,117,624 B2 10/2006 Kim
7,134,234 B1 11/2006 Makarounis
D536,116 S 1/2007 Sharrah
7,188,978 B2 3/2007 Sharrah et al.
7,199,315 B1 * 4/2007 Sharrah ..... F41G 1/34 200/61.43
7,199,351 B2 4/2007 Toma
D543,446 S 5/2007 DiNenna
7,243,454 B1 * 7/2007 Cahill ..... F41C 23/16 42/72
D548,385 S 8/2007 Sharrah et al.
7,260,910 B2 8/2007 Danielson
7,260,912 B2 8/2007 Liu
7,263,986 B2 9/2007 Lovell
7,264,369 B1 9/2007 Howe
7,273,292 B2 9/2007 Kim
7,310,903 B2 12/2007 Kim
7,325,352 B2 2/2008 Matthews et al.
7,332,682 B2 2/2008 Kim
D567,894 S 4/2008 Sterling et al.

(56) References Cited

U.S. PATENT DOCUMENTS 7,360,333 B2 4/2008 Kim
D568,508 S 5/2008 Howe et al.
D578,599 S 10/2008 Cheng
7,438,430 B2 10/2008 Kim
7,441,918 B2 10/2008 Kim
7,444,776 B2 11/2008 Adams
D585,516 S 1/2009 Smith
7,472,830 B2 1/2009 Danielson
7,493,722 B2 2/2009 Howe et al.
7,523,583 B2 4/2009 Cheng
7,543,405 B1 6/2009 Ivey
7,591,098 B2 9/2009 Matthews et al.
D603,478 S 11/2009 Hughes
7,614,760 B2 11/2009 Sharrah et al.
D612,970 S 3/2010 Sharrah et al.
7,674,003 B2 3/2010 Sharrah et al.
7,685,759 B2 3/2010 Teetzel
D616,956 S 6/2010 Rievley et al.
7,731,380 B2 6/2010 Wu
7,735,255 B1 6/2010 Kincaid et al.
7,736,013 B2 6/2010 Griffin
7,743,547 B2 6/2010 Houde-Walter
7,784,963 B2 8/2010 Galli et al.
7,805,876 B1 10/2010 Danielson et al.
7,819,547 B1 10/2010 Teetzel et al.
D628,323 S 11/2010 Matthews et al.
7,845,105 B1 * 12/2010 Cahill ..... F41C 27/00 42/117
7,896,518 B2 3/2011 Holmes et al.
7,913,441 B1 3/2011 Reed
D636,049 S 4/2011 Hughes et al.
D636,837 S 4/2011 Hughes et al.
7,941,960 B2 5/2011 Matthews et al.
7,954,971 B1 6/2011 Kincaid et al.
8,028,461 B2 10/2011 NuKyke
8,052,297 B2 11/2011 Gross et al.
8,109,032 B2 * 2/2012 Faifer ..... G03B 17/563 42/114
8,117,782 B2 2/2012 Gross et al.
8,132,355 B1 3/2012 Kincaid et al.
8,220,946 B1 7/2012 Teetzel
8,226,267 B2 7/2012 Sharrah et al.
8,256,154 B2 9/2012 Danielson et al.
D669,552 S 10/2012 Essig et al.
D669,553 S 10/2012 Hughes et al.
D669,956 S 10/2012 Hughes et al.
D669,958 S 10/2012 Essig et al.
D669,959 S 10/2012 Johnston et al.
8,276,307 B2 10/2012 Deros
8,276,573 B2 10/2012 Skell et al.
8,287,157 B2 10/2012 Sharrah et al.
D672,005 S 12/2012 Hedeen et al.
8,322,066 B2 12/2012 Westra
D673,709 S 1/2013 Sharrah
D674,525 S 1/2013 Sharrah et al.
D674,861 S 1/2013 Johnston et al.
D674,862 S 1/2013 Johnston et al.
8,353,125 B2 1/2013 Riley
8,371,729 B2 2/2013 Sharrah et al.
8,397,421 B2 3/2013 Ding et al.
8,453,369 B1 6/2013 Kincaid et al.
8,499,484 B2 8/2013 Schneider et al.
8,510,979 B1 8/2013 Mortimer
D689,162 S 9/2013 Hilbourne et al.
D692,518 S 10/2013 Anderson et al.
D693,898 S 11/2013 Essig et al.
8,578,647 B2 11/2013 Storch et al.
8,584,392 B1 11/2013 Young
D694,847 S 12/2013 Anderson et al.
D694,848 S 12/2013 Anderson et al.
D696,376 S 12/2013 Anderson et al.
8,607,492 B2 12/2013 Hartley et al.
D697,120 S 1/2014 Akita
8,650,793 B1 2/2014 Mendez
8,657,167 B2 2/2014 Horyna et al.
8,662,701 B2 3/2014 Sharrah et al.
8,683,631 B2 4/2014 Kowalczyk et al.
8,683,732 B2 4/2014 Joplin
8,683,733 B2 4/2014 Gross et al.
8,701,331 B2 4/2014 Schneider et al.
D704,297 S 5/2014 Cheng
8,727,556 B2 5/2014 Swan
8,727,561 B2 5/2014 Sharrah et al.
8,727,565 B2 5/2014 Domagaia et al.
D709,158 S 7/2014 Wells
D709,585 S 7/2014 Klecker et al.
D709,981 S 7/2014 Johnston et al.
8,779,583 B2 7/2014 Pressel et al.
8,779,683 B2 7/2014 Snyder et al.
8,783,908 B2 7/2014 Gross et al.
D712,001 S 8/2014 Wells
8,813,412 B2 8/2014 Rorick
8,820,690 B2 9/2014 Weber
8,850,735 B2 10/2014 Kenney
8,857,097 B2 10/2014 Rorick
8,904,698 B2 12/2014 Riley et al.
8,915,009 B2 12/2014 Caulk et al.
8,943,945 B1 2/2015 Collins
8,960,942 B2 2/2015 Galli et al.
8,973,296 B1 3/2015 Kocmich, IV
D729,339 S 5/2015 Chavez et al.
D732,134 S 6/2015 Wells
9,091,508 B2 7/2015 Prieto
D738,456 S 9/2015 Hughes
D738,987 S 9/2015 Hughes
D739,455 S 9/2015 Anderson et al.
9,134,094 B2 9/2015 Hilbourne et al.
D740,388 S 10/2015 Klecker et al.
D742,991 S 11/2015 Klecker et al.
9,222,749 B1 12/2015 Nakayama et al.
9,222,756 B1 12/2015 Battaglia et al.
D749,689 S 2/2016 Cheng et al.
9,303,955 B2 4/2016 Jeung et al.
9,322,617 B2 4/2016 Hartley et al.
D755,340 S 5/2016 Essig
D755,341 S 5/2016 Hartley
9,328,994 B2 5/2016 Hovsepian
9,377,271 B2 6/2016 Kowalczyk, Jr. et al.
9,389,050 B1 7/2016 Chen
D763,398 S 8/2016 Anderson
D763,399 S 8/2016 Anderson
D763,400 S 8/2016 Johnston
9,404,711 B1 8/2016 Hartley et al.
9,435,522 B2 9/2016 Galli et al.
9,441,923 B2 9/2016 Chadwick
9,453,707 B2 9/2016 Williams et al.
9,488,439 B2 11/2016 Galli et al.
9,506,721 B2 11/2016 Cheng et al.
D777,289 S 1/2017 Cheng et al.
9,551,550 B2 1/2017 Wells
9,568,282 B1 2/2017 Schorman
9,588,439 B1 3/2017 Bruguier et al.
9,605,931 B2 3/2017 Laporte et al.
9,658,031 B1 * 5/2017 Hedeen ..... F41C 33/0263
D792,544 S 7/2017 Hartley
9,726,447 B2 8/2017 Fridman et al.
9,772,161 B1 9/2017 Chenk
9,772,163 B2 9/2017 Sharrah et al.
9,810,411 B2 11/2017 Galli et al.
9,835,421 B2 12/2017 Laporte et al.
9,841,258 B1 12/2017 Galli et al.
9,853,436 B2 12/2017 Simon
9,891,023 B2 2/2018 Compton et al.
9,966,204 B2 * 5/2018 McCauley ..... F41G 11/003
9,991,062 B2 6/2018 Zimmer
10,001,342 B2 6/2018 Sharrah et al.
10,001,344 B1 6/2018 Alford et al.
10,024,632 B1 7/2018 Oglesby
10,041,765 B2 8/2018 McMakin
10,048,040 B1 8/2018 Ratliff
10,107,592 B1 10/2018 Huang et al.
10,151,564 B2 * 12/2018 Galli ..... F41G 11/003
10,323,914 B2 6/2019 Müller et al.
10,344,959 B2 7/2019 Worman et al.

(56) References Cited

U.S. PATENT DOCUMENTS 10,352,657 B2 7/2019 Galli et al.
10,365,069 B1 7/2019 Tayon et al.
10,365,072 B1 7/2019 Liu
10,514,235 B1 * 12/2019 McCauley ..... H01H 9/02
10,545,011 B1 1/2020 Collins
10,557,688 B2 2/2020 Batenhorst et al.
10,612,761 B1 4/2020 Worman et al.
10,619,977 B2 4/2020 Silvennoinen
10,641,583 B2 * 5/2020 Zimmer ..... F41G 11/003
10,677,563 B2 * 6/2020 Deng ..... F41G 9/00
10,835,960 B2 11/2020 Pierce et al.
D906,988 S * 1/2021 Zimmer ..... D22/108
10,942,009 B2 3/2021 Galli
11,015,896 B1 5/2021 Hochberg
11,052,300 B1 7/2021 Shie
11,105,586 B2 8/2021 Tayon et al.
D931,233 S 9/2021 Pan
11,137,233 B1 10/2021 Liu
D936,613 S * 11/2021 Zimmer ..... D22/108
11,175,114 B1 11/2021 Lee
11,255,531 B2 2/2022 Shorr, III
11,348,449 B2 5/2022 Zimmer
11,385,027 B2 7/2022 Galli
11,428,510 B2 8/2022 Arnold et al.
11,441,879 B1 9/2022 Dunning et al.
11,514,775 B2 11/2022 Zimmer
11,562,158 B2 1/2023 Schmitz
D981,965 S * 3/2023 Zimmer ..... D22/108
D992,507 S * 7/2023 Zimmer ..... D13/133
D999,870 S * 9/2023 Zimmer ..... D22/108
11,761,733 B1 * 9/2023 Meyrath ..... F41G 11/001
42/114
11,820,805 B2 11/2023 Yan et al.
D1,016,956 S * 3/2024 Zimmer ..... D13/133
12,031,797 B2 * 7/2024 Teetzel ..... F41G 11/003
12,082,366 B2 * 9/2024 Lee ..... F41C 27/00
12,196,529 B2 * 1/2025 Teetzel ..... F41C 23/16
D1,073,000 S * 4/2025 Zimmer ..... D13/133
2001/0022044 A1 9/2001 Spinner
2002/0100202 A1 8/2002 Lin et al.
2002/0100204 A1 8/2002 Kim
2003/0101632 A1 6/2003 Davenport et al.
2003/0106252 A1 6/2003 Hines
2003/0202345 A1 10/2003 Kim
2004/0000083 A1 1/2004 Grant
2004/0064994 A1 4/2004 Luke
2004/0148842 A1 8/2004 Aalto et al.
2004/0216352 A1 11/2004 Wooten et al.
2005/0243542 A1 * 11/2005 Kim ..... F41G 1/34
362/110
2005/0246937 A1 11/2005 Kim
2005/0257415 A1 11/2005 Solinsky et al.
2006/0075672 A1 4/2006 Romer
2006/0196099 A1 9/2006 Matthews et al.
2006/0242882 A1 11/2006 Liu
2007/0006512 A1 1/2007 Williams et al.
2007/0023022 A1 2/2007 Lentz
2007/0068058 A1 3/2007 Remo
2007/0068059 A1 3/2007 Kim
2007/0074444 A1 4/2007 Kim
2007/0113462 A1 5/2007 Ho
2007/0147042 A1 6/2007 Sharrah et al.
2007/0183103 A1 8/2007 Cheng
2007/0227056 A1 10/2007 Howe et al.
2007/0235298 A1 * 10/2007 Kim ..... F41G 1/34
200/18
2007/0253189 A1 11/2007 Kim
2007/0266611 A1 11/2007 Stover
2007/0277422 A1 12/2007 Ding
2008/0022576 A1 1/2008 Epling
2008/0040965 A1 2/2008 Solinsky et al.
2008/0092423 A1 4/2008 Keng
2008/0094823 A1 4/2008 Kim
2008/0148619 A1 6/2008 Rogers et al.
2008/0205037 A1 8/2008 Griffin
2008/0253110 A1 10/2008 Wu
2009/0013580 A1 1/2009 Houde-Walter
2009/0183416 A1 7/2009 Danielson
2009/0190339 A1 7/2009 Galli et al.
2009/0190341 A1 7/2009 Galli et al.
2009/0241396 A1 10/2009 Fitzpatrick et al.
2009/0293335 A1 12/2009 Danielson
2009/0293855 A1 12/2009 Danielson et al.
2009/0307956 A1 12/2009 Barret
2010/0020535 A1 1/2010 Sharrah et al.
2010/0043271 A1 2/2010 Williams et al.
2010/0097789 A1 4/2010 Sharrah et al.
2010/0176741 A1 7/2010 Sharrah et al.
2010/0229449 A1 9/2010 Matthews et al.
2010/0229450 A1 9/2010 Becker et al.
2010/0237124 A1 9/2010 Troy
2010/0254135 A1 10/2010 Bayat et al.
2010/0263256 A1 10/2010 Spinelli
2011/0047850 A1 3/2011 Rievley et al.
2011/0058362 A1 3/2011 Sun et al.
2011/0061283 A1 3/2011 Cavallo et al.
2011/0099873 A1 5/2011 Bentley
2011/0162251 A1 7/2011 Houde-Walter
2011/0261559 A1 * 10/2011 Couture ..... F21L 4/005
362/208
2011/0290968 A1 12/2011 Maughan et al.
2012/0055061 A1 3/2012 Hartley et al.
2012/0055062 A1 3/2012 Mironichev et al.
2012/0085013 A1 4/2012 Cahill
2012/0096755 A1 4/2012 Griffin
2012/0124885 A1 5/2012 Caulk et al.
2012/0138034 A1 6/2012 Whidborne
2012/0144718 A1 6/2012 Danielson et al.
2012/0167436 A1 7/2012 Westra
2012/0168589 A1 7/2012 Riley
2012/0198745 A1 8/2012 Riley et al.
2012/0216550 A1 8/2012 Riley et al.
2012/0227304 A1 9/2012 Engelhardt
2012/0266514 A1 10/2012 Michal et al.
2013/0000176 A1 1/2013 Goertzen
2013/0061506 A1 3/2013 Atkinson
2013/0133238 A1 5/2013 Quetschke et al.
2013/0148367 A1 6/2013 Sharrah et al.
2013/0185932 A1 7/2013 Hilbourne et al.
2013/0318852 A1 12/2013 Teetzel et al.
2014/0018508 A1 1/2014 Masabuchi et al.
2014/0092588 A1 4/2014 Toman et al.
2014/0109457 A1 4/2014 Speroni
2014/0196349 A1 7/2014 Rogers et al.
2014/0252187 A1 9/2014 Petrovic
2014/0305021 A1 10/2014 Prieto
2014/0360077 A1 12/2014 Miller et al.
2014/0373329 A1 12/2014 Volfson
2015/0124436 A1 5/2015 Galli et al.
2015/0143735 A1 5/2015 Ley
2015/0159847 A1 6/2015 Galli et al.
2015/0204638 A1 7/2015 Frazier
2015/0241169 A1 8/2015 Cheng et al.
2015/0241174 A1 8/2015 Silvennoinen
2015/0267999 A1 9/2015 Hovsepian
2015/0276347 A1 10/2015 Sharrah et al.
2015/0276352 A1 10/2015 Chang et al.
2015/0300386 A1 10/2015 Fong et al.
2016/0003460 A1 1/2016 Li et al.
2016/0025120 A1 1/2016 Swan et al.
2016/0091272 A1 3/2016 Hines
2016/0091278 A1 3/2016 Jen
2016/0146572 A1 5/2016 Ley
2016/0161220 A1 6/2016 Moore et al.
2016/0169610 A1 6/2016 Hines
2016/0195366 A1 7/2016 Kowalczyk et al.
2016/0209168 A1 7/2016 Sharrah et al.
2016/0209174 A1 7/2016 Hartley et al.
2016/0209175 A1 7/2016 Sharron et al.
2016/0211095 A1 * 7/2016 Zimmer ..... H01H 9/0235
2016/0349013 A1 12/2016 Ley
2016/0377385 A1 12/2016 Culp
2017/0052003 A1 2/2017 Liu
2017/0138701 A1 5/2017 Kowalczyk, Jr. et al.

(56) References Cited

U.S. PATENT DOCUMENTS

| | | | | |
|---|---|---|---|---|
| 2017/0167817 | A1 | 6/2017 | Hayes | |
| 2017/0176151 | A1 | 6/2017 | Liu | |
| 2017/0191801 | A1 | 7/2017 | Tresserras Torre et al. | |
| 2017/0219314 | A1 | 8/2017 | McMaldin | |
| 2017/0234646 | A1 | 8/2017 | Flagler | |
| 2017/0234653 | A1 | 8/2017 | Maughn | |
| 2017/0248389 | A1 | 8/2017 | DiCarlo et al. | |
| 2018/0023926 | A1 | 1/2018 | Jayaprakash | |
| 2018/0031352 | A1 | 2/2018 | Zeisler et al. | |
| 2018/0038580 | A1 | 2/2018 | Galli et al. | |
| 2018/0053607 | A1 | 2/2018 | McCauley et al. | |
| 2018/0094904 | A1 | 4/2018 | Greenwood | |
| 2018/0142991 | A1 | 5/2018 | Rogers et al. | |
| 2018/0164078 | A1 | 6/2018 | Hancosky | |
| 2018/0180390 | A1 | 6/2018 | Müller et al. | |
| 2018/0216911 | A1 | 8/2018 | Jen | |
| 2018/0283670 | A1 | 10/2018 | Galli et al. | |
| 2018/0364009 | A1 | 12/2018 | Hancosky | |
| 2019/0154243 | A1 | 5/2019 | Worman et al. | |
| 2019/0242677 | A1 | 8/2019 | Ding et al. | |
| 2019/0316882 | A1 | 10/2019 | Galli et al. | |
| 2019/0323541 | A1 | 10/2019 | Windfeldt et al. | |
| 2020/0064102 | A1* | 2/2020 | Galli | H05B 45/00 |
| 2020/0143667 | A1* | 5/2020 | Zimmer | F41A 35/00 |
| 2020/0232601 | A1 | 7/2020 | Chavez et al. | |
| 2021/0054964 | A1 | 2/2021 | Chen et al. | |
| 2021/0055078 | A1 | 2/2021 | Roberson | |
| 2021/0088310 | A1* | 3/2021 | Planck | F41G 11/003 |
| 2021/0108891 | A1 | 4/2021 | Ma et al. | |
| 2021/0239308 | A1* | 8/2021 | Gerlings | F21L 4/005 |
| 2021/0254930 | A1 | 8/2021 | Pischke | |
| 2021/0302123 | A1 | 9/2021 | Mayberry et al. | |
| 2021/0333068 | A1 | 10/2021 | Lindsay et al. | |
| 2021/0356231 | A1 | 11/2021 | Tayon et al. | |
| 2021/0372742 | A1 | 12/2021 | Arnold | |
| 2021/0381810 | A1 | 12/2021 | LaPorte et al. | |
| 2022/0018637 | A1 | 1/2022 | Wright et al. | |
| 2022/0057171 | A1* | 2/2022 | Lindblom, Jr. | F41G 1/36 |
| 2022/0136800 | A1 | 5/2022 | Lee et al. | |
| 2022/0205764 | A1 | 6/2022 | LaPorte et al. | |
| 2022/0325990 | A1 | 10/2022 | LaPorte et al. | |
| 2022/0349683 | A1 | 11/2022 | LaPorte et al. | |
| 2022/0412696 | A1 | 12/2022 | Teetzel et al. | |
| 2022/0412703 | A1 | 12/2022 | Dunning et al. | |
| 2024/0035779 | A1* | 2/2024 | Teetzel | F41G 11/00 |

FOREIGN PATENT DOCUMENTS

| | | | |
|---|---|---|---|
| CN | 217442401 | U | 9/2022 |
| KR | 20130025779 | B1 | 10/2013 |

OTHER PUBLICATIONS

M-LOK® Tape Switch Mounting Plate—Insight® PEQ, Model MAG631, https://magpul.com/m-lok-tape-switch-mounting-plate-insight-peq.html?mp_global_color=118, accessed Mar. 4, 2026.

Cloud Defensive product, https://shop.opticsplanet.com/cloud-defensive-brand.html, accessed Mar. 4, 2026.

B&H, SureFire Tape Switch, https://www.bhphotovideo.com/c/product/520202-REG/Surefire_SR07_Tape_Switch.html/reviews?ap=y&ap=y&smp=y&smp=y&smpm=e_f83mkz_uar&Isft=BI%3A514&gclid=EAIaIQobChMI_vT-25Kn_glVpQ2tBh0oTgQtEAQYByABEgJ-9fD_BwE, accessed Mar. 4, 2026.

SureFire, "2002 Surefire Weaponlight Catalog", pp. 34 and 37, published 2002.

United States Department of Defense, Military Standard: Dimensioning of Accessory Mounting Rail for Small Arms Weapons, MIL-STD-1913, Feb. 3, 1995.

SureFire, "2002 Surefire Weaponlight Catalog", pp. 48, 49, 52 and 53, published 2002.

SureFire, SR07 WeaponLight Switch, Jul. 11, 2025, 4 pages, https://web.archive.org/web/20230604201138/https://www.surefire.com/sr07-weaponlight-switch/.

* cited by examiner

WEAPON REMOTE SWITCH ASSEMBLY

CROSS-REFERENCE TO RELATED APPLICATION

The present application claims priority to U.S. Provisional Patent App. No. 63/514,374, filed Jul. 19, 2023, the entirety of which is hereby incorporated by reference.

FIELD

The present disclosure generally relates to firearm accessories such as illuminators (e.g., lights and/or lasers), and more particularly to switches for such accessories.

BACKGROUND

Various types of accessories are mounted on weapons. Some such accessories are illuminators, including lights and/or lasers. Switches may be used to turn such illuminators on/off, to change operation mode, etc.

SUMMARY

In one aspect, a remote switch system is for use with a firearm mounted accessory. The remote switch system comprises a switch assembly including a switch and a switch housing. The remote switch system includes a kit of switch mounts. The kit of switch mounts includes at least a first switch mount and a second switch mount. The first and second switch mounts are interchangeably useable with the switch assembly for forming a remote switch. The first switch mount includes a switch receiver configured to receive the switch assembly. The first switch mount is configured to connect to a first type of firearm connection structure. The second switch mount includes a switch receiver configured to receive the switch assembly. The second switch mount is configured to connect to a second type of firearm connection structure different from the first firearm connection structure.

In another aspect, a remote switch is for use with a firearm accessory. The remote switch comprises a switch housing and a switch supported by the switch housing. A tether is provided for operatively connecting the switch to the firearm accessory. A power source is supported by the switch housing and is operatively connected to the tether for providing power to the firearm accessory.

In another aspect, a remote switch is for use with a firearm accessory on a firearm. The remote switch comprises a switch assembly including a switch for receiving user input. The remote switch comprises a switch mount including a switch assembly receiver configured to receive the switch assembly. The switch mount includes a top opening via which the switch is accessible for receiving user input when the switch assembly is received by the switch receiver. The switch mount includes a bottom defining an opening permitting the switch assembly to be received by the switch assembly receiver from the bottom of the switch mount. The switch mount includes a firearm connector for mounting the switch mount on the firearm.

In another aspect, a remote switch is for use with a firearm accessory on a firearm. The remote switch comprises a switch assembly including a switch housing and a switch supported by the switch housing. The remote switch comprises a switch mount configured to mount on the firearm. The switch mount includes a switch assembly connector. The switch assembly connector is resiliently deformable to permit connection of the switch mount with the switch assembly by resilient deformation of the switch assembly connector.

In yet another aspect, a remote switch is for use with a firearm accessory on a firearm. The remote switch comprises a switch assembly including a switch housing and a switch supported by the switch housing. The switch assembly includes a tether for operatively connecting the switch with the firearm accessory. A switch mount has a bottom portion configured to mouth on the firearm. The switch mount includes a switch assembly receiver for connecting the switch mount and switch assembly. The switch assembly receiver is configured to position the switch to be actuated from above the bottom portion of the switch mount. The switch mount includes a passage configured to permit the tether to pass from the switch assembly receiver to the firearm accessory. The passage is accessible for installation of the tether in the passage from a bottom surface of the bottom portion.

Other objects and features of the present disclosure will be in part apparent and in part pointed out herein.

BRIEF DESCRIPTION OF THE DRAWINGS

Corresponding reference numbers indicate corresponding parts throughout the drawings.

DETAILED DESCRIPTION

Figure 1:
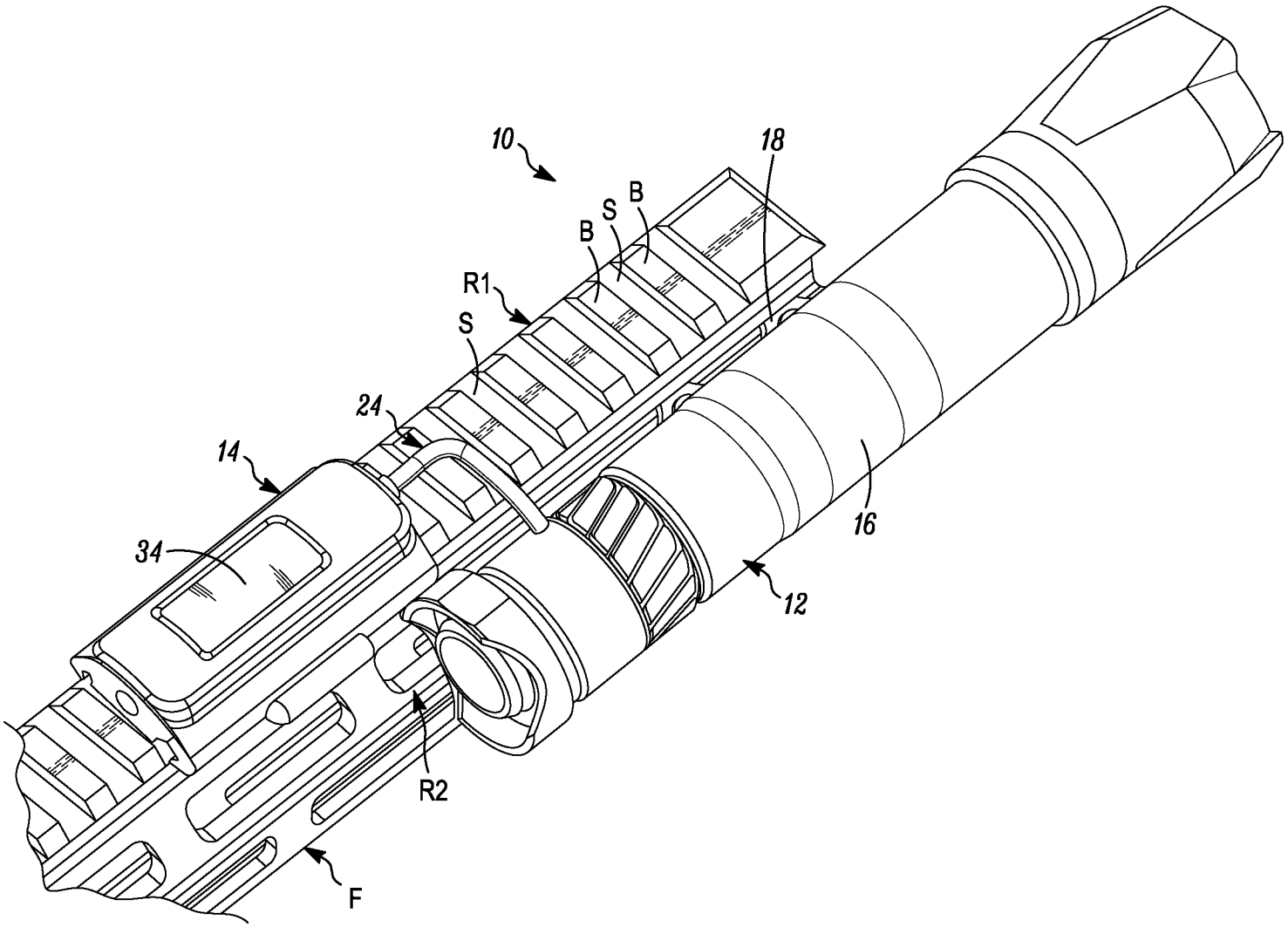
FIG. 1 is a fragmentary perspective of a firearm having a firearm accessory system mounted thereon, the firearm accessory system including a remote switch assembly and firearm accessory mounted on the firearm.
Figure 2:
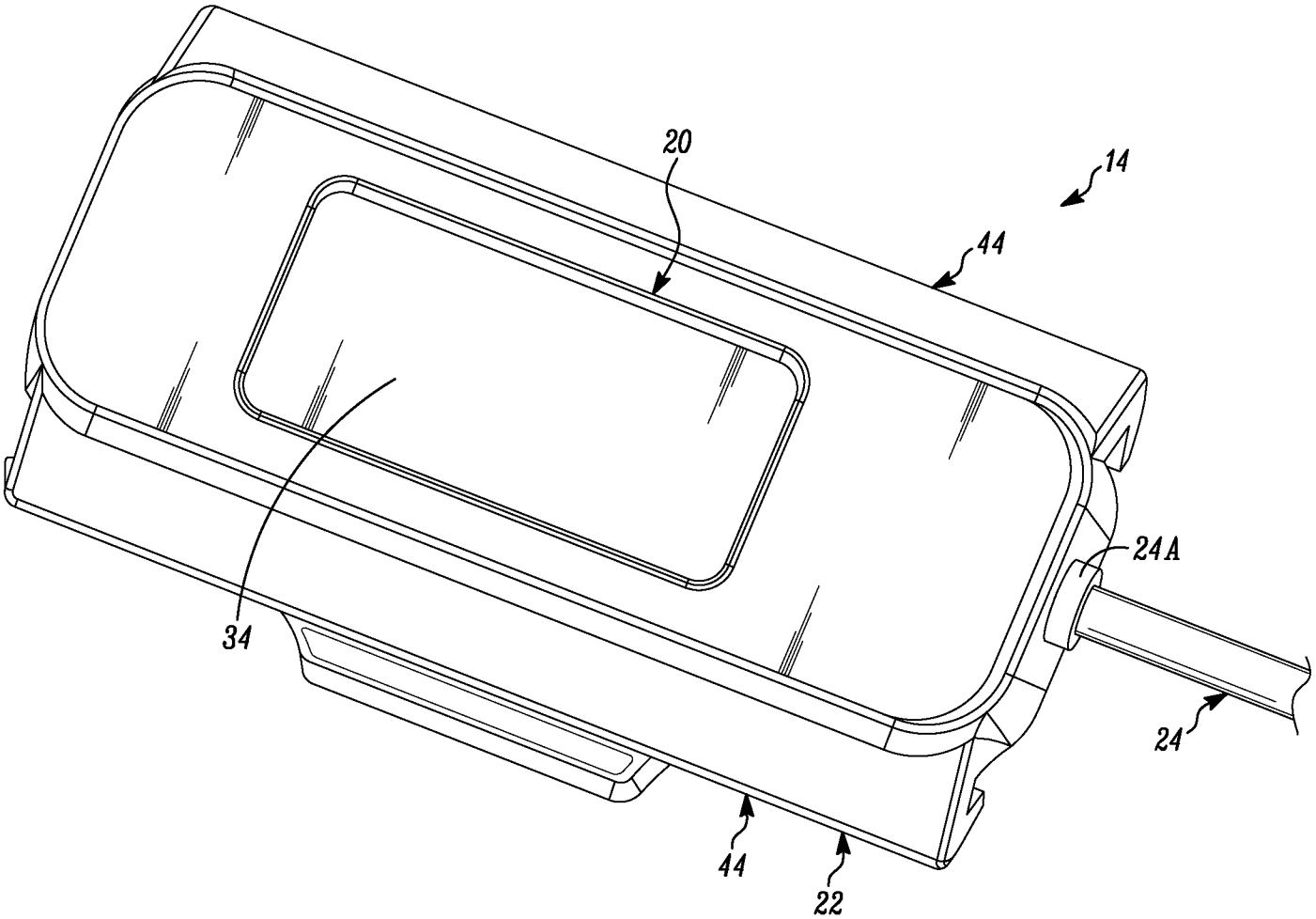
FIG. 2 is a top perspective of the remote switch assembly of FIG. 1.
Figure 3:
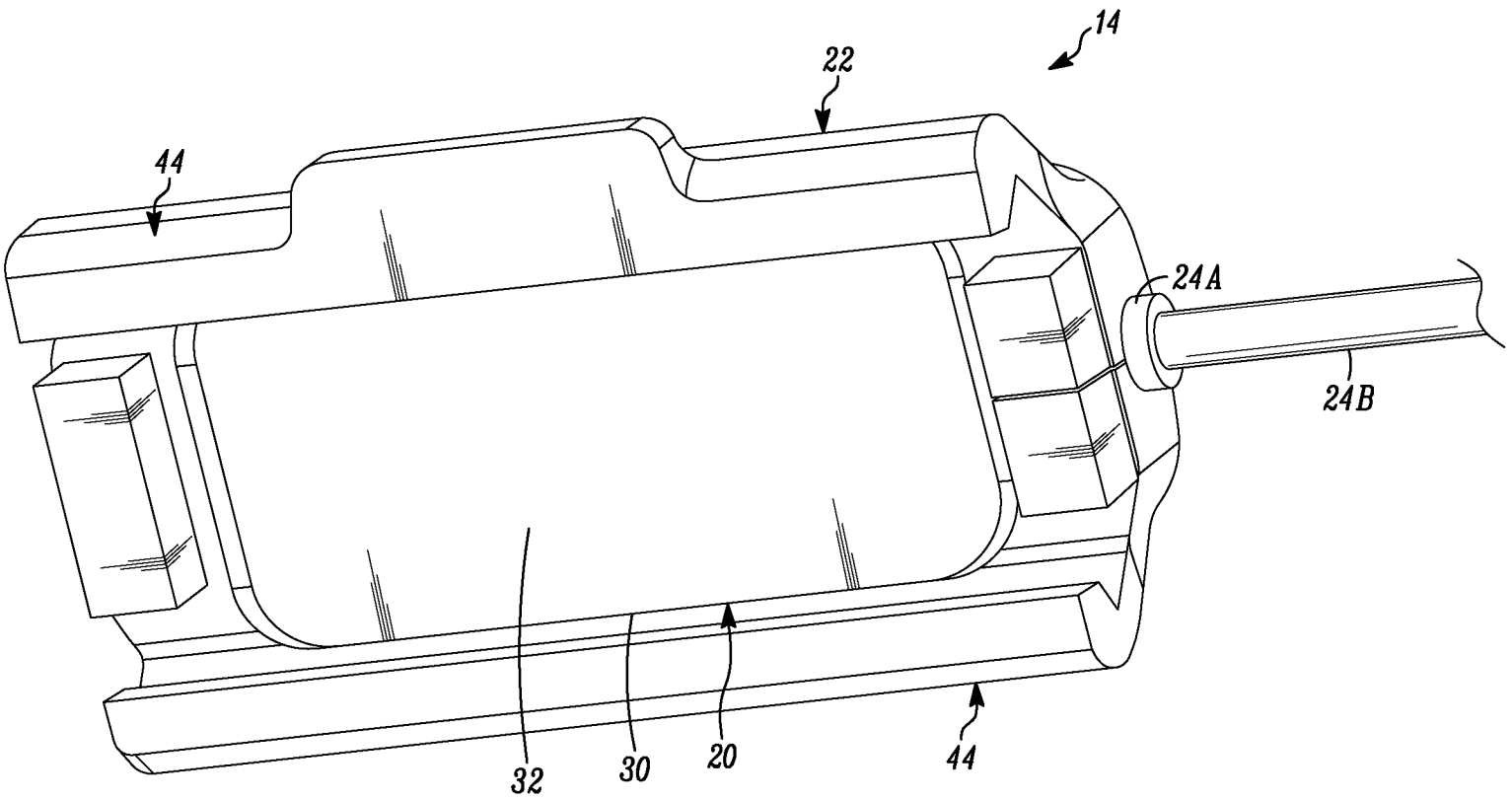
FIG. 3 is a bottom perspective of the remote switch assembly.

Referring to FIG. 1, a firearm accessory system of the present disclosure is generally indicated by 10. The firearm accessory system comprises a firearm accessory 12 and a remote switch 14 connected to the firearm accessory. In the illustrated embodiment, the firearm accessory 12 comprises an illuminator, and more specifically, a light. The accessory 12 includes an accessory body 16 (e.g., illuminator body) and an accessory mount 18 configured to mount the accessory to the firearm F. The accessory body 16 houses a power source (e.g., battery) and a light source, such as an LED. The light source is configured to emit light out a front of the accessory body to illuminate an area in front of the firearm F. It will be appreciated that other accessories, such as other illuminators (e.g., lights and/or lasers), could be used without departing from the scope of the present disclosure.

Referring to FIGS. 2-7, the remote switch 14 includes a switch assembly 20 and a switch mount 22. The switch assembly 20 includes a tether 24 for operatively connecting the remote switch 14 to the accessory 12. As explained in further detail below, the switch mount 22 is configured to mount the switch assembly 20 to the firearm F, and the switch assembly can be used to execute various functions with respect to the accessory, such as turn the accessory 12 on/off and/or change operational modes of the accessory (e.g., brightness, strobe, etc.). The remote switch 14 is "remote" in the sense that it can be mounted to the firearm F remote from the accessory 12 such that the accessory can be mounted in a desired location for its operation (e.g., adjacent the front of the firearm) and the remote switch can be mounted in a location where the user can more easily actuate the remote switch while holding the firearm.

Figure 4:
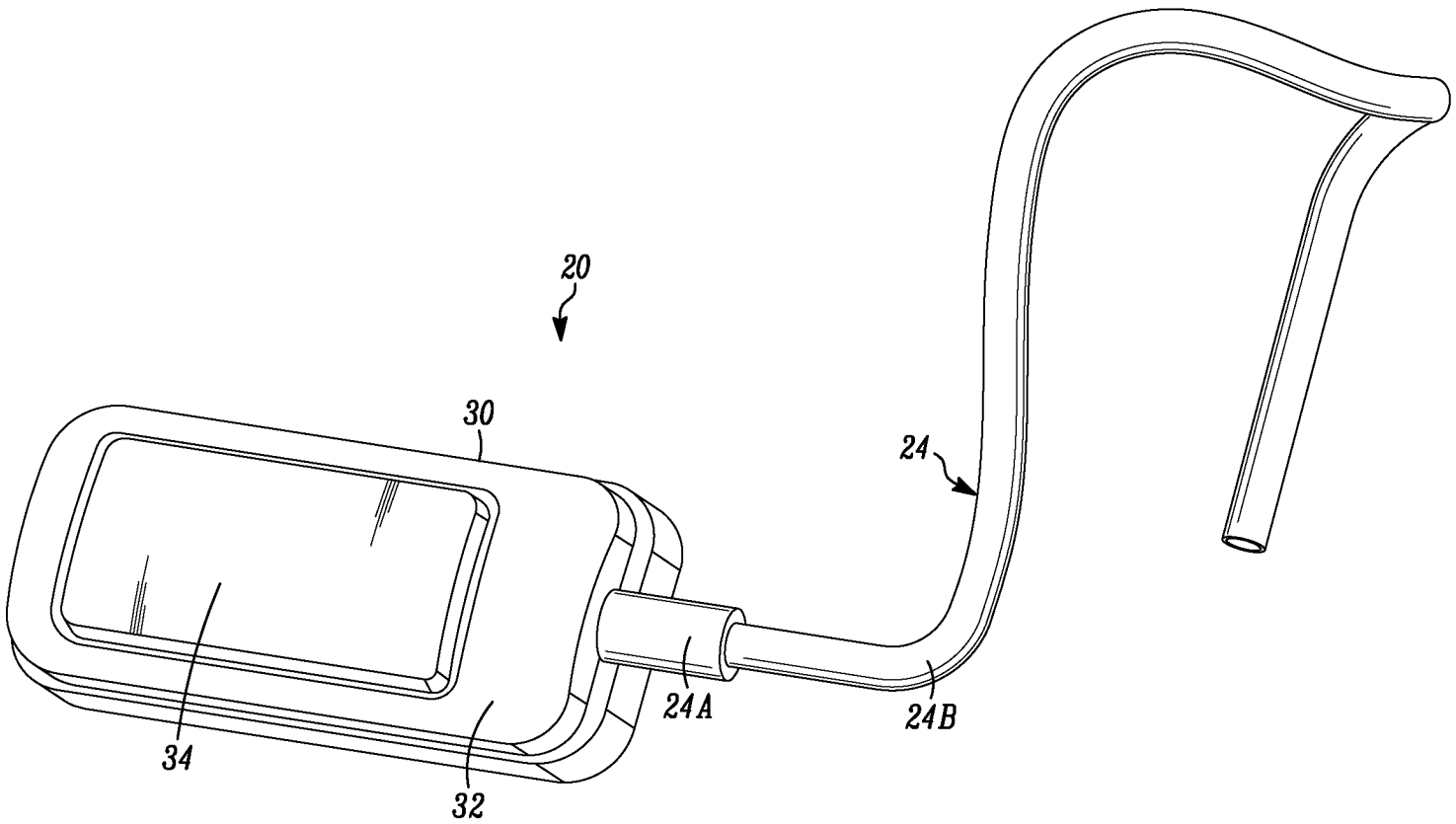
FIG. 4 is a top perspective of a switch assembly of the remote switch assembly.
Figure 5:
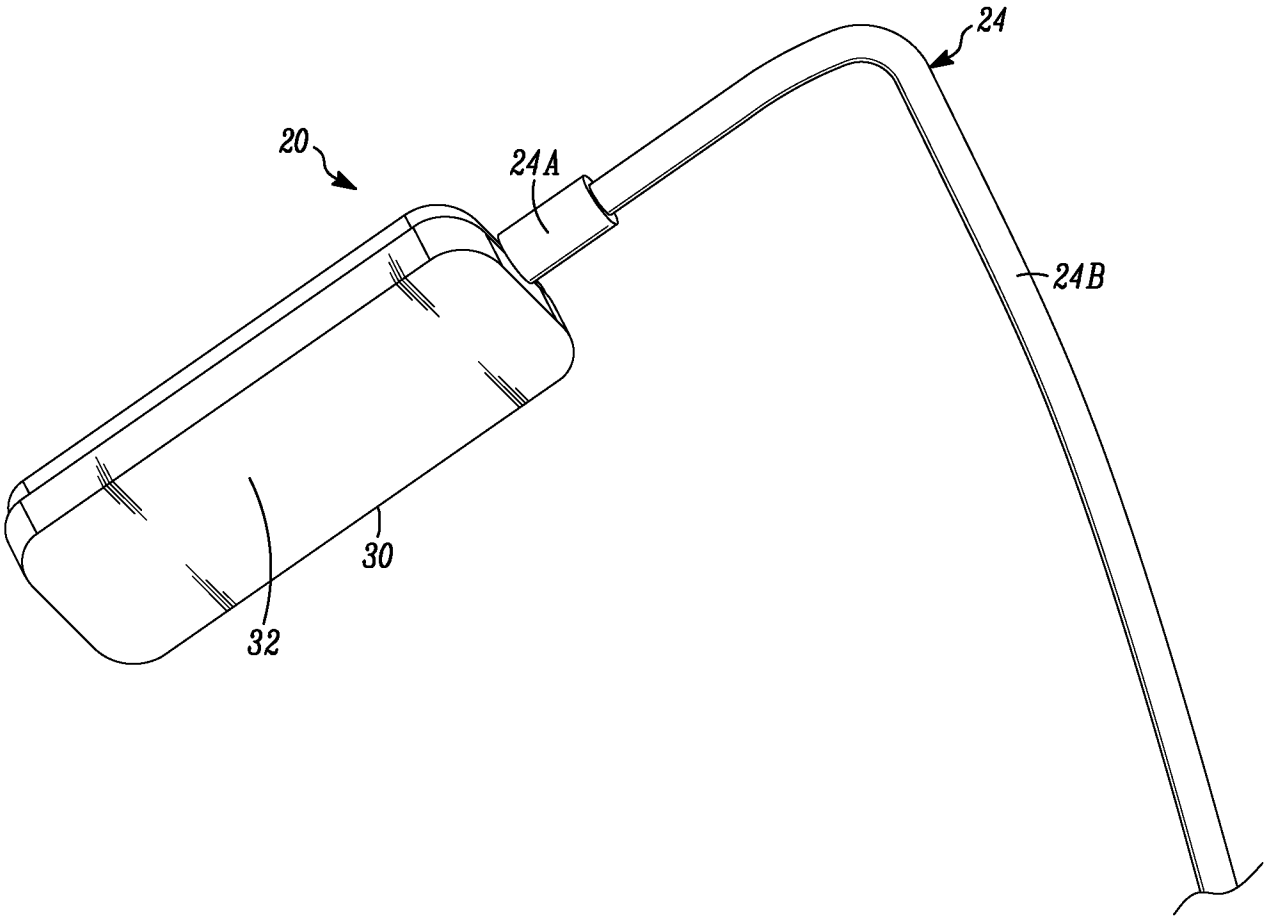
FIG. 5 is a bottom perspective of the switch assembly.

Referring to FIGS. 4 and 5, the switch assembly 20 comprises a switch housing 30 including a housing body 32 and an actuator 34. In the illustrated embodiment, the switch housing 30 has a bottom side, a top side opposite the bottom side, a rear end, a front end opposite the rear side, a left side, and a right side opposite the left side. The housing body 32 can be formed of a generally rigid plastic. The actuator 34 is provided on the top side of the switch housing 30. In the illustrated embodiment, the actuator 34 comprises a flexible cover over a switch (e.g., digital switch, such as a dome switch) inside the housing 30. For example, the flexible cover 34 can be overmolded onto the housing body 32 to cover a top opening of the housing body. The user can actuate the internal switch by pressing the actuator 34. Together, the switch and cover 34 form a button. For example, the switch may be mounted on a circuit board (broadly, "internal electronic components") secured inside the housing 30. The switch is configured to be in operative communication with the accessory 12 via the tether 24. The tether 24 extends from the front end of the housing 30. The tether 24 includes a proximal end secured to the switch housing 30 and extends to a distal end having a suitable connector for connecting to the accessory. The tether 24 includes a fitting 24A at the front end of the housing 30 and a cord 24B extending from the fitting toward the distal end of the tether.

The switch actuator 34 can be actuated in various ways, such as tap-and-release or long-hold (sustained-press-and-release). For example, a tap and release may toggle the accessory 12 between on/off, and a long-hold may cause the switch to operate as a momentary switch by which the accessory 12 is on only for the time the actuator is pressed and held by the user. Other configurations can be used without departing from the scope of the present disclosure.

Figure 6:
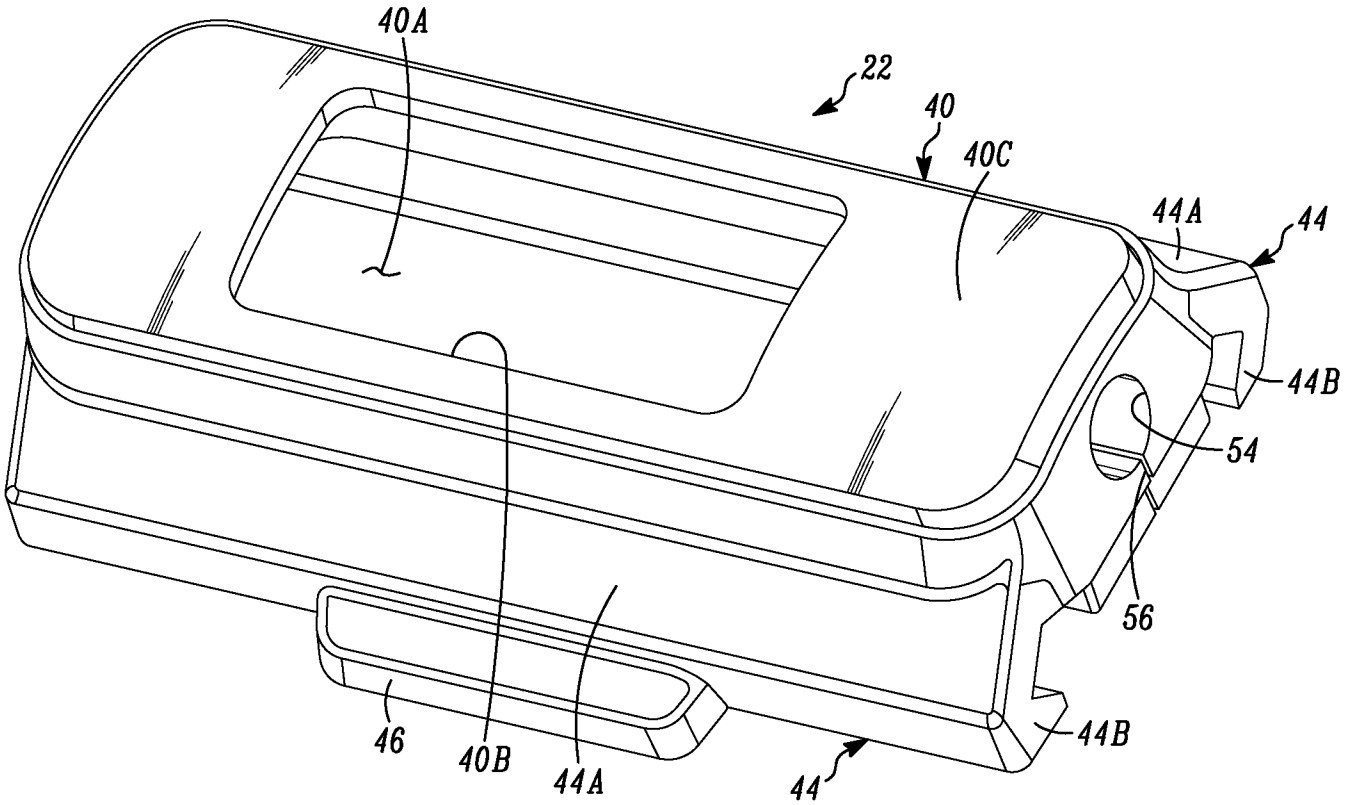
FIG. 6 is a top perspective of a switch mount of the remote switch assembly.
Figure 7:
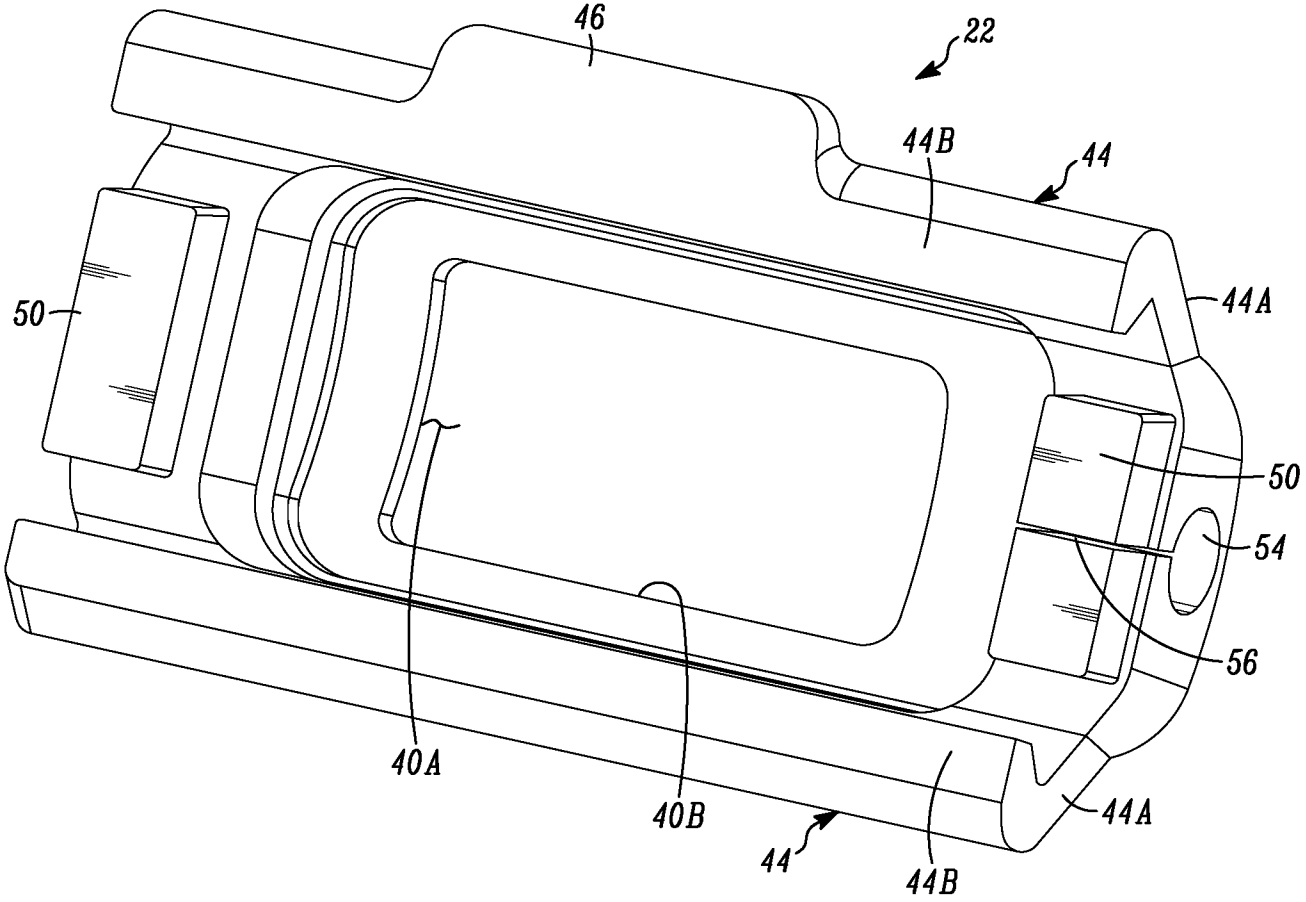
FIG. 7 is a bottom perspective of the switch mount.

Referring to FIGS. 6 and 7, the switch mount 22 will be described in more detail. The switch mount 22 includes a mount body 40 defining a recess 40A configured to receive the switch assembly 20 from a bottom of the mount body. The mount body 40 includes a top opening 40B through which the switch actuator 34 is exposed when the switch assembly 20 is combined with the switch mount 22. In the illustrated embodiment, the switch assembly receiving recess 40A is sized and shaped to closely conform to the housing 30 of the switch assembly 20 to hold the switch assembly in position with respect to the mount 22. The mount body 40 has an upper portion 40C which may serve as a cover for covering the housing of the switch assembly.

The switch mount 22 includes a lower portion defining jaws 44 (broadly, "firearm connectors") for connecting the switch mount to the firearm F. The jaws 44 each comprise a wing 44A and a foot 44B. The jaws 44 oppose each other and define a rail receiving space therebetween for receiving a rail of the firearm F. A tab 46 is provided on one of the jaws 44 to facilitate the user in manipulating the jaw to install and uninstall the jaw from the firearm rail. In the illustrated embodiment, the jaws 44 are configured to connect to a dovetail style rail, such as a Picatinny rail R1 (FIG. 1) (first type of firearm mounting structure) having an elongate rail body including ribs B and slots S extending across a top of the rail body. The jaws 44 define V-shaped grooves configured to receive sides of the dovetail rail R1. The switch mount 22 includes first and second rail keys 50 (e.g., lugs) that protrude downward. The rail keys 50 are configured to be received in the slots S of the dovetail rail R1. The switch mount 22 can be formed of a resiliently deformable material, such as a molded rubber (e.g., TPE) or another suitable material. The arrangement is such that the jaws 44 are resiliently deformable to "snap" over the sides of the dovetail rail R1. When the jaws 44 are located on the sides of the dovetail rail R1, the rail keys 50 are received in slots S of the rail to prevent the mount 22 from sliding along the length of the rail. The switch mount 22 is configured to hold the bottom side of the switch assembly housing 30 against the top of the rail R1 to secure the switch assembly in position on the firearm F.

The switch mount 22 is configured to permit assembly of the switch assembly 20 with the switch mount prior to mounting of the mount on the firearm F. For example, the switch assembly 20 can be oriented so the actuator 34 faces the bottom of the mount 22, and then the switch assembly can be moved upward to locate the switch assembly housing 30 in the recess 40A of the mount 22. The mount 22 is configured to facilitate installation of the tether 24 of the switch assembly 20. In the illustrated embodiment, the front end of the mount 22 defines a tether receiver comprising a port 54 (in a front wall of the mount) and a slot 56 leading to the port from the underside of the mount. In particular, the slot 56 passes through the front slot key 50 and the bottom of the upper portion of the mount. The slot 56 is normally closed (e.g., opposing surfaces of slot abutting or being adjacent across a small gap) in an at-rest configuration of the mount without the switch assembly 20 installed. The slot 56 can be opened by temporarily deforming (e.g., resiliently flexing) the mount 22 to permit access of the tether 24 into the port 54. For example, the user can grasp the opposite jaws 44 and bend the upper portion of the mount 22 to cause the slot 56 to open. The port 54 serves as a passage (e.g., having a front opening, rear opening, and channel therebetween) from the switch receiver recess 40A through the front end of the mount 22 for passage of the tether to the accessory 12. The port 54 and slot 56 can be referred to as a switch assembly connector of the switch mount 22 that is configured to form a connection with the switch assembly by resilient deformation of the switch connector. Accordingly, installation of the switch assembly 20 on the mount 22 can be accomplished without disconnecting the tether 24 from the switch assembly housing 30, and comprises flexing the mount 22 (e.g., deform relative to an at-rest state) and permitting the mount to resiliently retract (e.g., resiliently return toward the at-rest state). The switch assembly housing 30 is moved upward into the recess 40A of the mount 22 substantially simultaneously with installation of the tether 24 in the port. The reception of the tether 24 (e.g., the fitting 24A) in the port 54 may provide a friction fit and serves to hold the switch assembly 20 in position with respect to the mount 22 (e.g., before mounted on the firearm). It will be appreciated that other configurations can be used without departing from the scope of the present disclosure. For example, the slot may normally be open or partially open and not require flexing of the mount for installation of the switch assembly.

After the switch assembly 20 is installed on the mount 22, the mount can be mounted on the firearm F. For example, one of the jaws 44 can be located to receive a side of the dovetail rail R1, and the mount 22 can be pivoted to push the other jaw 44 against the other side of the rail. The flexible material of the mount 22 is configured to permit the jaws 44 to deflect away from each other in response to the second jaw being pushed against the firearm rail R1 to separate the first and second jaws. The flexible material is configured to resiliently return the first jaw 44 toward the second jaw 44 to snap the mount onto the firearm rail R1 when the rail keys 50 are received in the slots in the rail.

Figure 8:
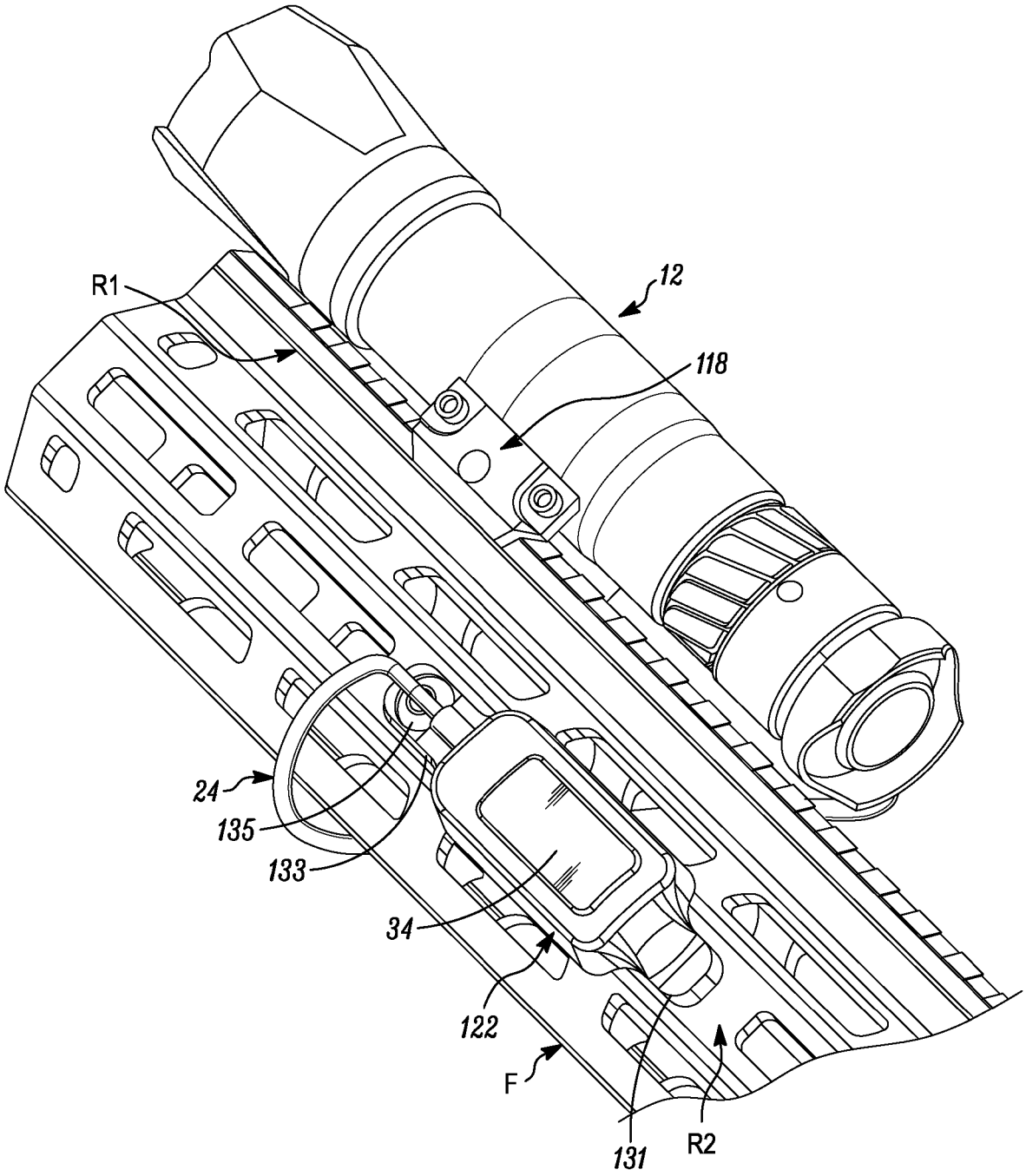
FIG. 8 is a fragmentary perspective of a firearm having a second firearm accessory system mounted thereon, the firearm accessory system including a remote switch assembly, including the switch assembly of FIG. 4, and a second embodiment of a switch mount.
Figure 9:
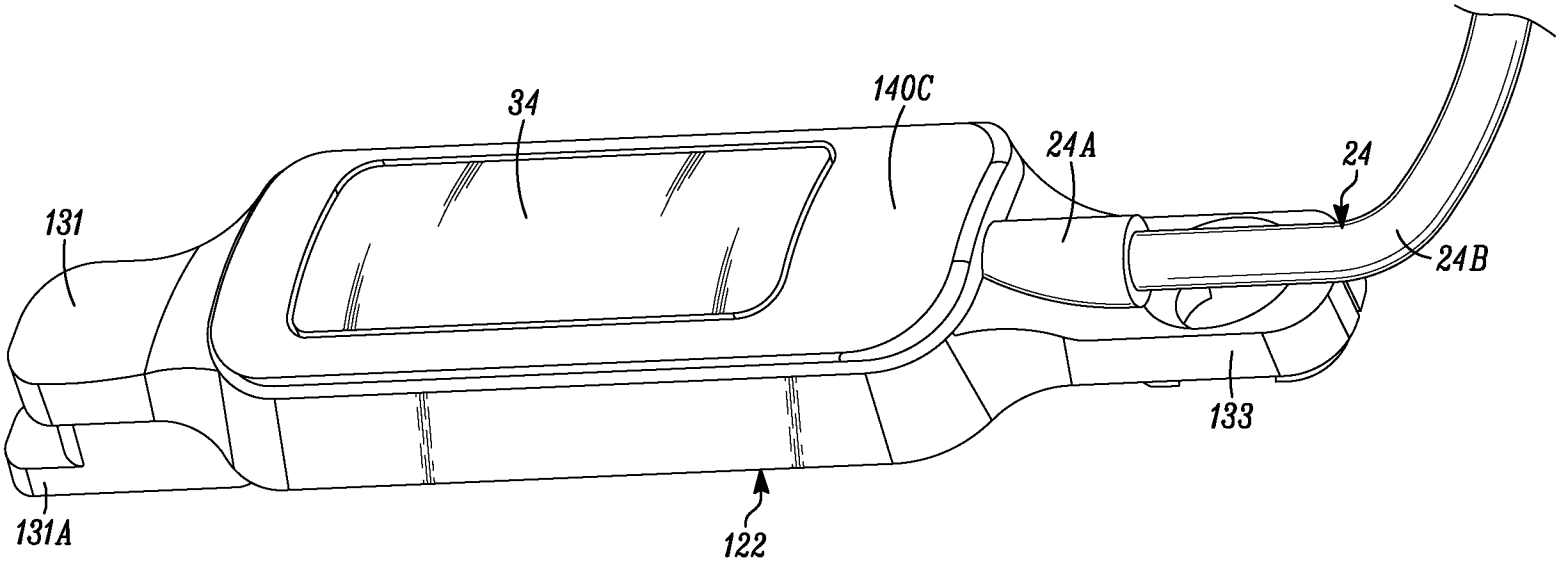
FIG. 9 a top perspective of the remote switch assembly of FIG. 8.
Figure 10:
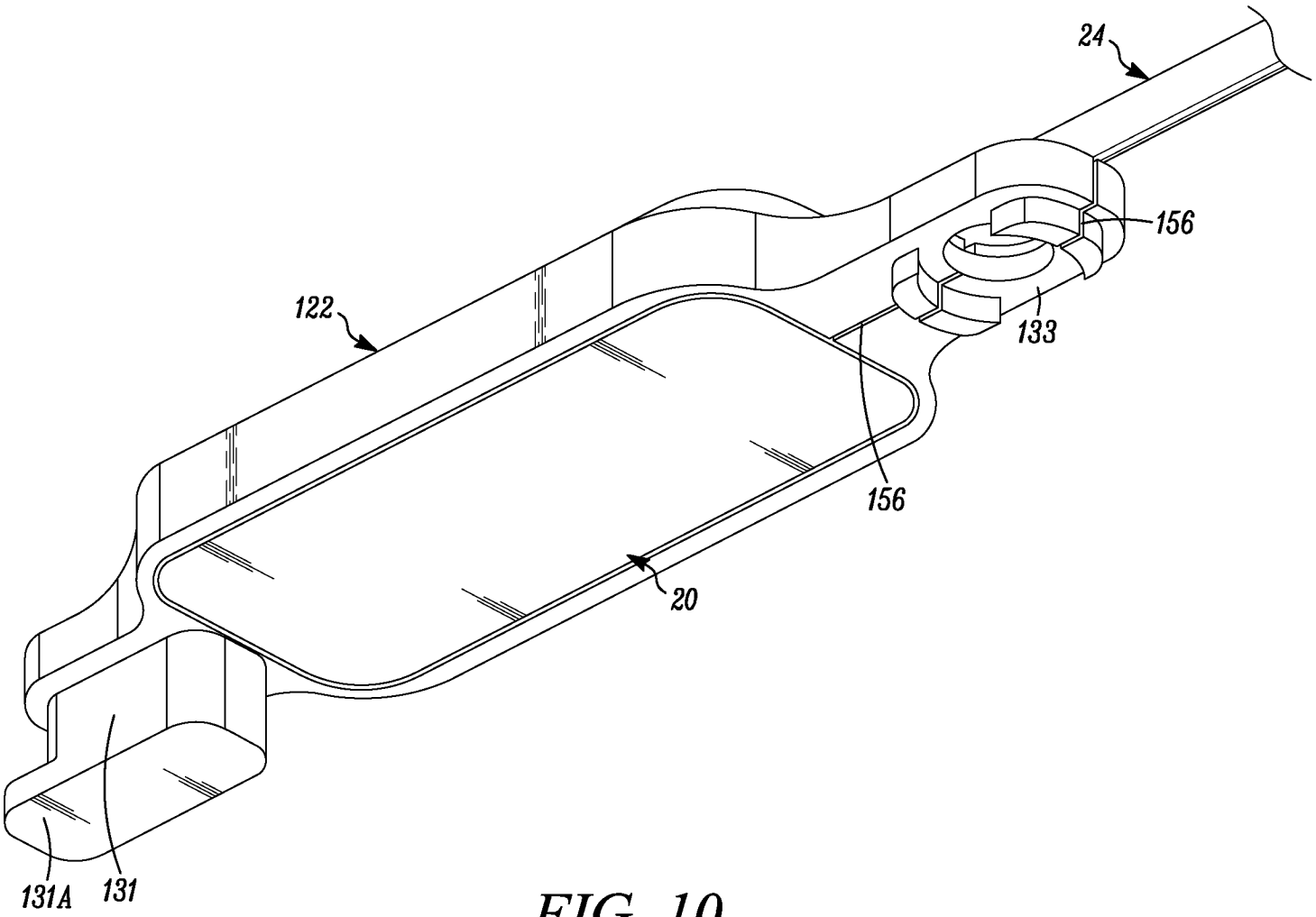
FIG. 10 is a bottom perspective of the remote switch assembly.

A second embodiment of a switch mount 122 will now be described with reference to FIGS. 8-12. The switch mount 122 is similar to the switch mount 22 described above, and like components are labeled with like reference numbers, plus 100. For example, the switch mount 122 includes an upper portion 140C defining a switch assembly recess 140A sized and shaped for receiving and closely conforming to the housing 30 of the switch assembly 20. The mount 122 includes an upper opening 140B through which the switch actuator 34 is exposed when the switch assembly 20 is received in the mount. In this embodiment, the switch mount 122 is configured for use with an M-LOK style rail R2 of a firearm (second type of firearm mounting structure). For example, in FIG. 8, the mount 122 is shown mounted on an M-LOK style rail R2 of a firearm F. In FIG. 8, the accessory 12 is shown as having a clamp mount 118 configured to clamp to a dovetail rail R1 adjacent the M-LOK rail R2.

Figure 11:
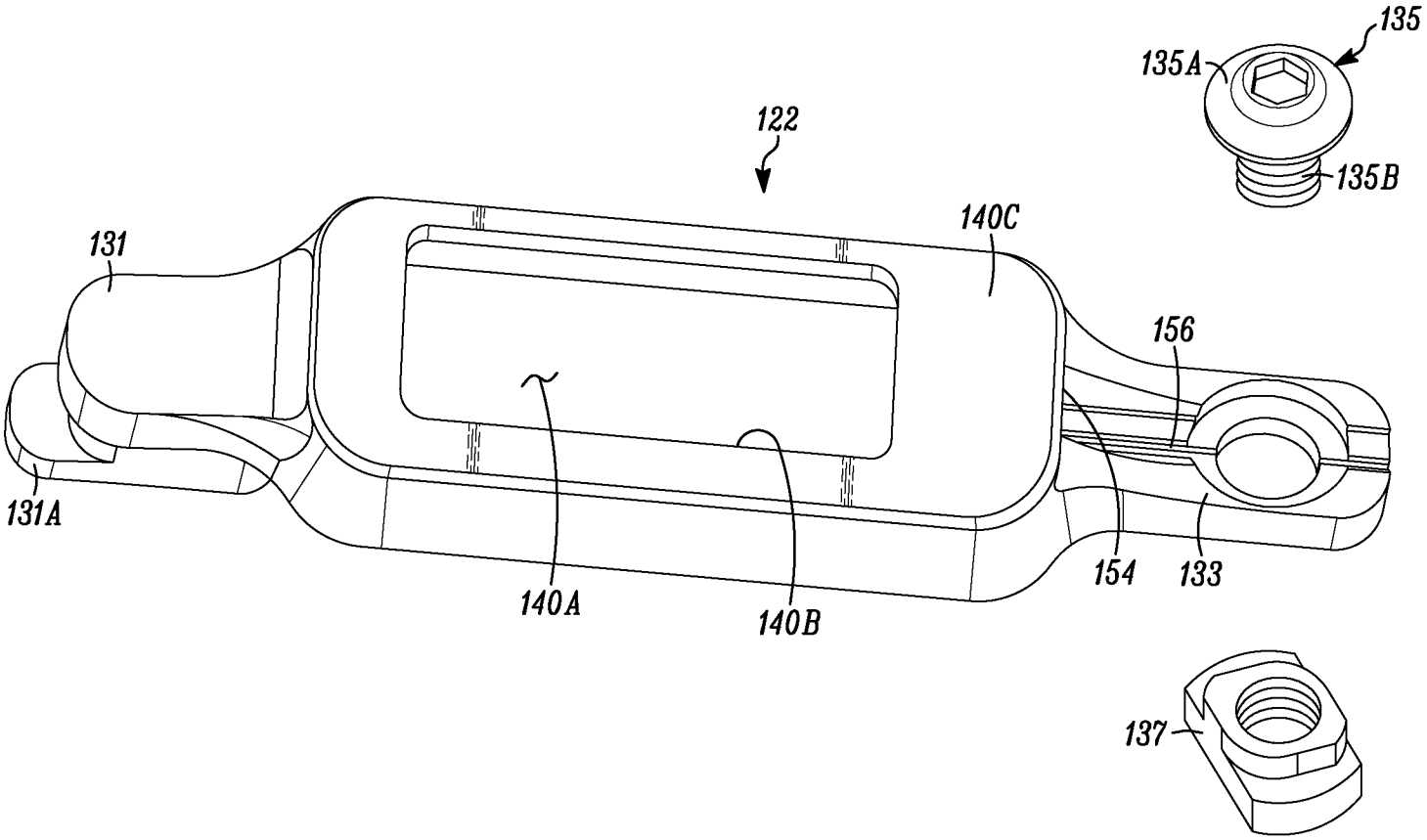
FIG. 11 is a top perspective of the switch mount of FIG. 8.
Figure 12:
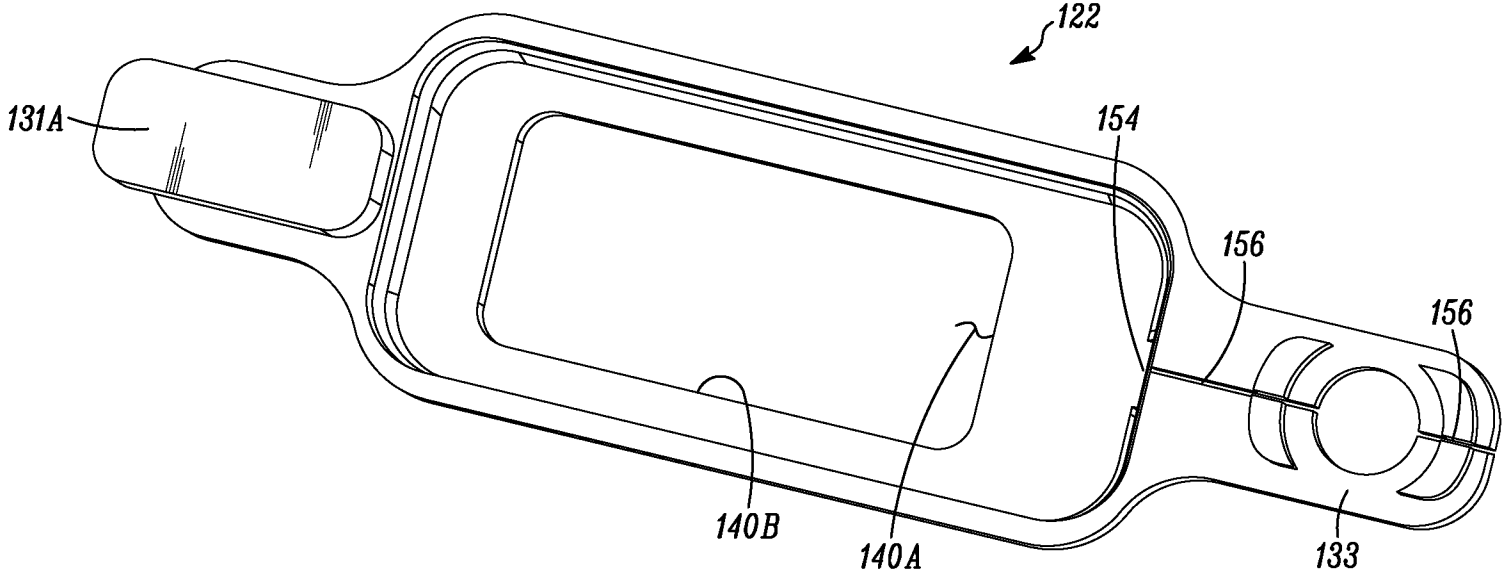
FIG. 12 is a bottom perspective of the switch mount.

In this embodiment, the switch mount 122 includes a rear firearm connector 131 including a foot 131A configured for reception in a slot of the M-LOK rail R2, and a forward firearm connector 133 defining a fastener receiver for a fastener 135. For example, as shown in FIG. 11, the fastener 135 may comprise a screw or bolt having a head 135A and a threaded shaft 135B sized to pass through an opening of the firearm connector 133. The fastener 135 is threaded into a T-shaped nut 137. When the mount 122 is installed on the M-LOK style rail R2, the rear foot 131A is received in an end of a slot segment of the firearm rail, and the T-shaped nut 137 is received in a slot segment of the firearm rail. The fastener 135 is then turned to cause the threaded engagement of the fastener and T-shaped nut 137 to turn the nut crosswise with respect to the slot segment and then to draw the T-shaped nut toward the firearm connector 133 to tighten the mount 122 in position.

Like the switch mount 22 described above, the switch mount 122 is configured to permit assembly of the switch assembly 20 with the switch mount prior to mounting of the mount on the firearm F. For example, the switch assembly 20 can be oriented so the actuator 34 faces the bottom of the mount 122, and then the switch assembly can be moved upward to locate the switch assembly housing 30 in the recess 140A of the mount. The mount 122 is configured to facilitate installation of the tether 24 of the switch assembly 20. In the illustrated embodiment, the front end of the mount 122 defines a tether receiver comprising a port 154 (in a front wall of the mount) and a slot 156 leading to the port from the underside of the mount. In particular, the slot 156 passes through the front firearm connector 133 and the bottom of the upper portion 140C of the mount 122. The slot 156 is normally closed (opposing surfaces of slot abutting or being adjacent across a small gap) in an at-rest configuration of the mount without the switch assembly 20 installed. The slot 156 can be opened by temporarily deforming (e.g., resiliently flexing) the mount to permit access of the tether into the port. For example, the user can grasp and bend the mount 122 to cause the slot 156 to open. The port 154 serves as a passage (e.g., having a front opening, rear opening, and channel therebetween) from the switch receiver recess 140A through the front end of the mount 122 for passage of the tether 24 to the accessory 12. Accordingly, installation of the switch assembly 20 on the mount 122 can be accomplished without disconnecting the tether 24 from the switch assembly housing 30, and comprises flexing the mount (e.g., deform relative to an at-rest state) and permitting the mount to resiliently retract (e.g., resiliently return toward the at-rest state). The switch assembly housing 30 is moved upward into the recess 140A of the mount substantially simultaneously with installation of the tether 24 in the port 154. The reception of the tether 24 (specifically, the fitting 24A) in the port 156 may provide a friction fit and serves to hold the switch assembly 20 in position with respect to the mount 122 (e.g., before mounted on the firearm). The tether 24 extends over the top of the head 135A of the fastener 135 when the remote switch is installed on the firearm F. It will be appreciated that other configurations can be used without departing from the scope of the present disclosure. For example, the slot may normally be open or partially open and not require flexing of the mount for installation of the switch assembly.

The switch assembly 20 can be provided with a kit of switch mounts (e.g., including at least two mounts, such as mount 22 and mount 122) to permit a user to form a remote switch assembly as desired to mount on a rail R1, R2 of the user's firearm F. The switch assembly 20 is interchangeable with the mounts 22, 122 of the kit to be mountable to the type of rail R1, R2 desired for mounting. Instead of providing multiple remote switches having different mount types, the switch assembly 20 can be interchangeably paired with switch mounts 22, 122 of the kit for forming a desired remote switch assembly. More than two switch mounts may be provided in such a kit for connecting to various types of firearm connection structure.

Figure 13:
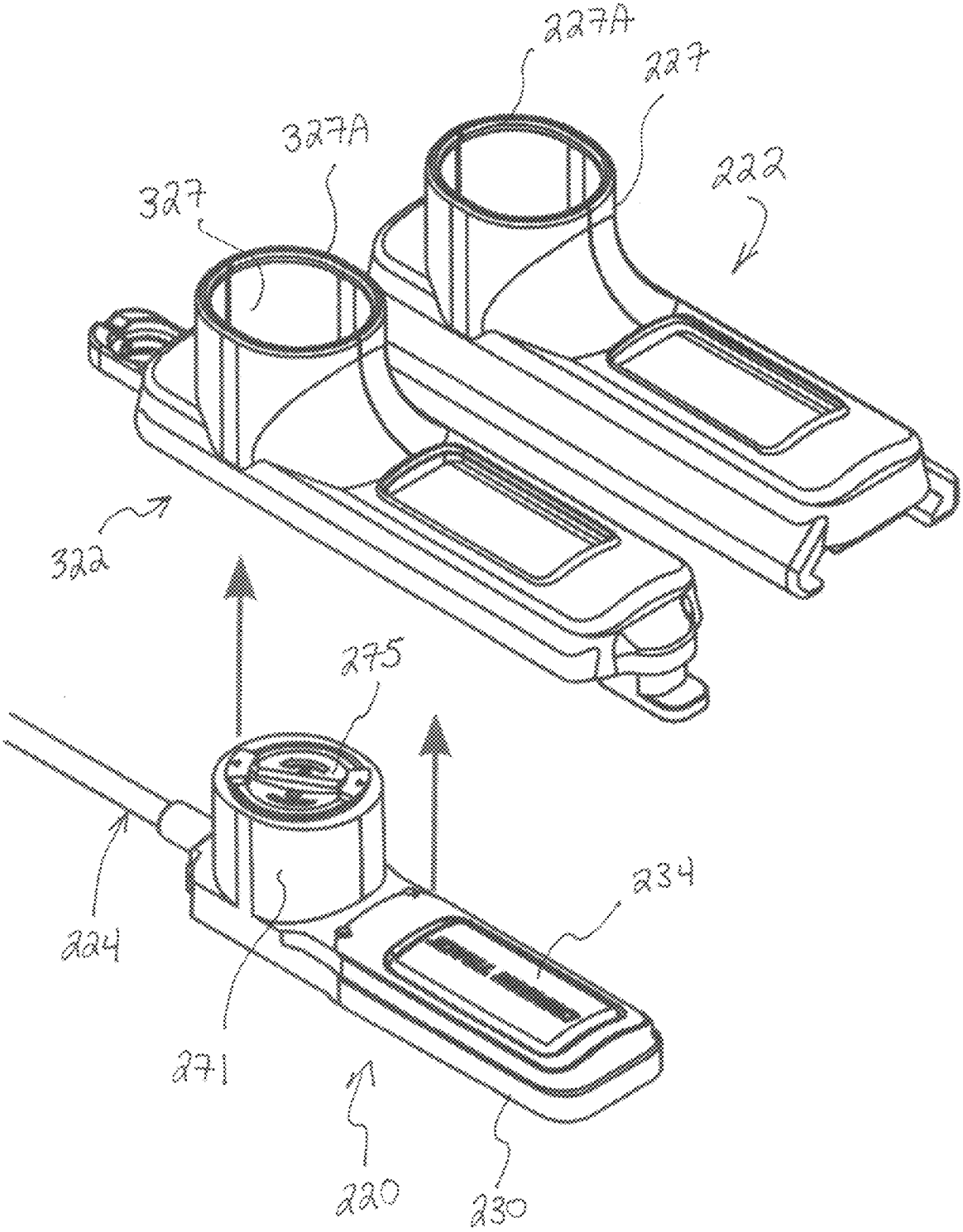
FIG. 13 is a perspective of a kit of additional first and second switch mounts interchangeably useable with another switch assembly for selectively making a remote switch assembly.
Figure 14:
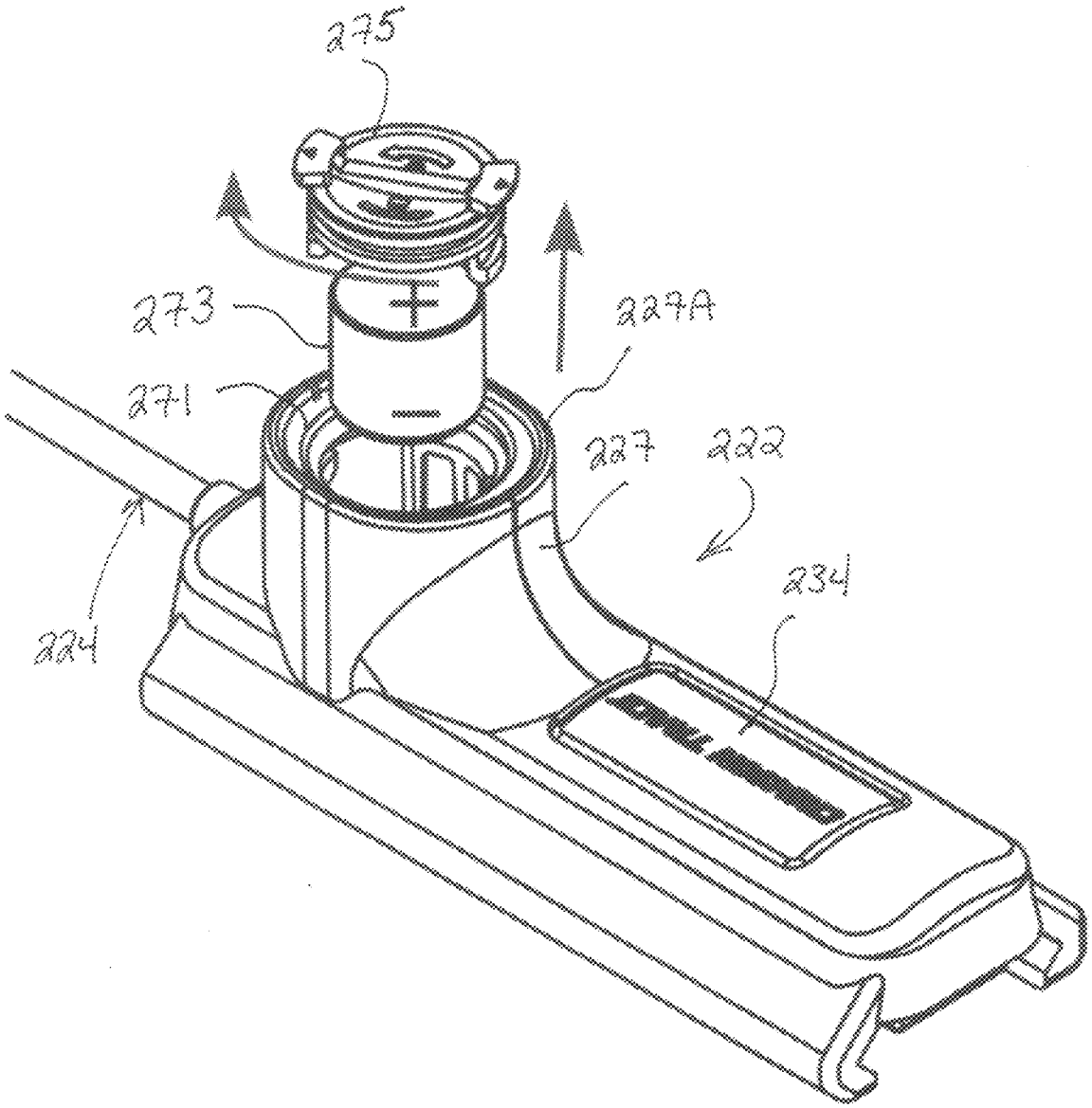
FIG. 14 is a top perspective of a remote switch assembly including the switch mount and switch assembly of FIG. 13, a battery cover and battery shown removed from the switch assembly.

Referring now to FIGS. 13-14, another embodiment of a switch assembly 220 is shown with another kit of switch mounts 222, 322 for selectively forming a remote switch assembly. The switch assembly 220 is similar to the switch assembly 20 described above, and like components are indicated by like references numbers, plus 200. For example, a tether 224 extends from the switch assembly housing 230 for operatively connecting the switch assembly 220 with a firearm accessory 212 (e.g., illuminator, such as a light and/or laser). Moreover, the switch assembly 220 includes an actuator 234 in the form of a cover overmolded on the housing body to cover an upper opening of the housing body. The cover overlies an internal switch 251 (e.g., digital switch) mounted on a circuit board (broadly, "circuit board structure") in the housing 230. Other configurations can be used without departing from the present disclosure.

Figure 15:
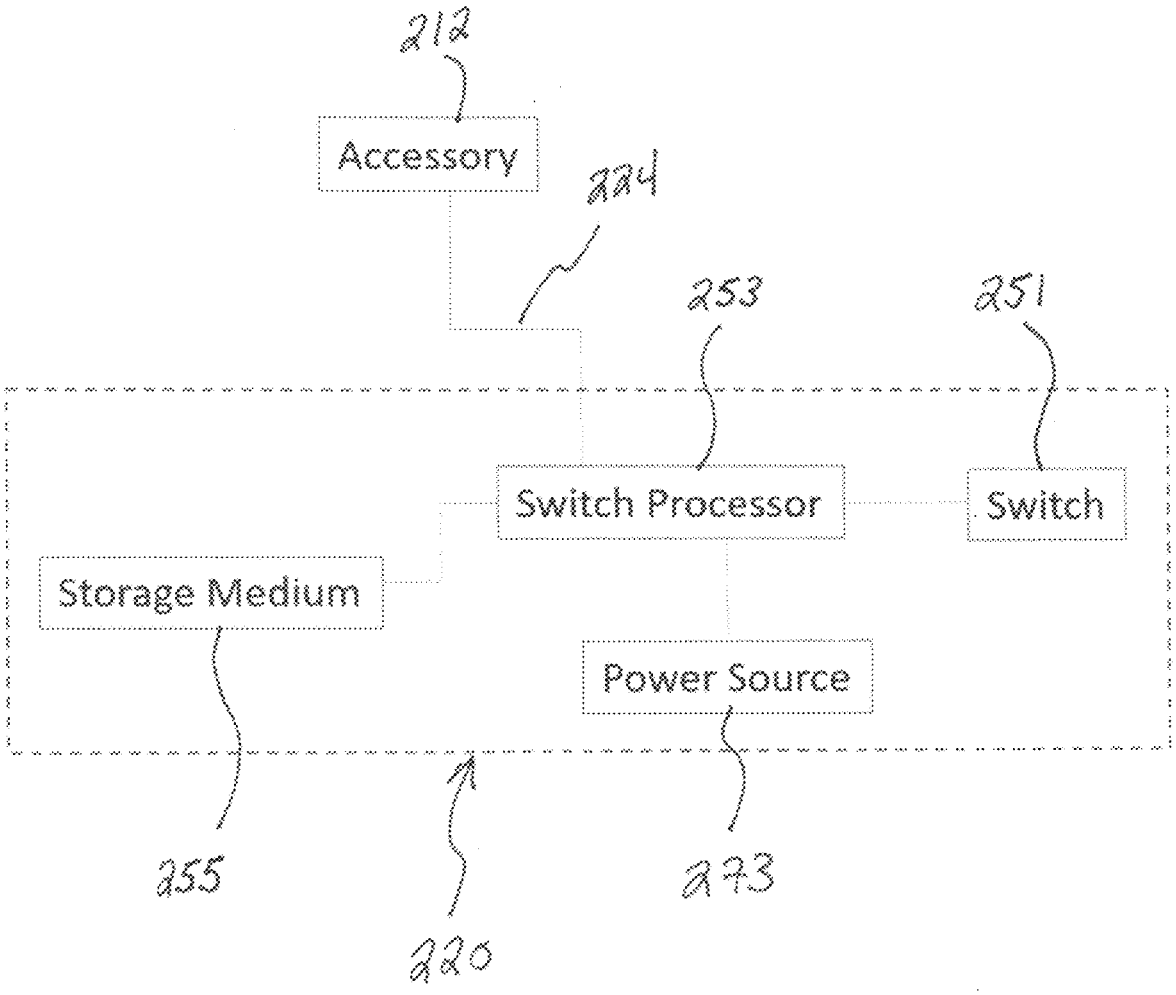
FIG. 15 is a schematic of a control system of a firearm accessory assembly including a remote switch assembly comprising the switch assembly of FIG. 13.

In this embodiment, referring to FIG. 15, the circuit board structure includes a switch processor 253 and a non-transitory tangible storage medium 255 storing instructions executable by the switch processor. The switch processor 253 is responsive to user input from the switch 251 via the switch actuator 234, and executes instructions stored by the tangible storage medium 255 responsive to the user input. For example, in response to a tap-and-release of the actuator 234, per instructions stored in the storage medium 255, the switch processor 253 may transmit one or more command signals to the firearm accessory 212, such as to turn on or to turn off, such that successive tap-and-release actuations function like toggling on/off. Alternatively, in response to the actuator 234 being pressed and held, the switch processor 253 may transmit one or more command signals to the firearm accessory 212 such that the switch 251 acts as a momentary switch, by which the accessory is on while the actuator is pressed and turns off when the actuator is released. Other configurations can be used. For example, presses of the actuator 234 in sequence within a threshold time may cause the accessory to cycle through various functions (e.g., strobe, different brightness levels). Moreover, the switch may comprise a mechanical switch rather than a digital switch.

In this embodiment, the switch assembly 220 includes a battery receiver 271 configured for holding a battery 273 (broadly, "power source"). The switch assembly housing 230 includes a generally cylindrical upward protruding housing portion defining the battery receiver. A cap 275 is releasably connectable to the battery receiver 271 to retain the battery therein. The battery 273 is operatively connected to the switch processor 253 via the circuit board structure to provide power to the processor. Optionally, the battery 273 can also be used as a power source for the firearm accessory (e.g., light and/or laser). In such a case, the firearm accessory 212 may include a housing with a light source (LED or laser) that is powered by the battery 273 carried by the remote switch assembly 220, and the firearm accessory may not itself include a power source.

The switch mount 222 is essentially the same as the switch mount 22 described above, except the switch mount 222 is dimensioned to accommodate the larger switch housing 230 and includes a battery receiver cover 227 forming a cavity in which the battery receiver 271 is located when the switch assembly 220 is installed on the switch mount 222. The battery receiver cover 227 has a top opening 227A to permit access to the battery receiver and for installation and removal of the cap 275.

The switch mount 322 is essentially the same as the switch mount 122 described above, except the switch mount 322 is dimensioned to accommodate the larger switch housing 230 and includes a battery receiver cover 327 forming a cavity in which the battery receiver 271 is located when the switch assembly 220 is installed on the switch mount 322. The battery receiver cover 327 has a top opening 327A to permit access to the battery receiver 227 and for installation and removal of the cap 227A.

Accordingly, it will be appreciated that the switch assembly 220 is interchangeably useable with the switch mounts 222, 322 to form a remote switch, in a similar was as described above, to accommodate a user's needs of mounting on various types of firearm rails R1, R2.

It will be apparent that modifications and variations are possible without departing from the scope of the invention defined in the appended claims.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A remote switch system for use with a firearm mounted accessory, the remote switch system comprising:

a switch assembly including a switch actuator and a switch housing, the switch actuator configured to receive user input; and a kit of switch mounts, the kit of switch mounts including at least a first switch mount and a second switch mount, the first and second switch mounts being interchangeably useable with the switch assembly for forming a remote switch;

the first switch mount being configured to connect to a first type of firearm connection structure, the first switch mount including a first switch receiver configured to receive the switch assembly, the first switch receiver including:

a first switch assembly receiving recess sized and shaped to receive the switch assembly; and a first top opening via which the switch actuator is accessible for receiving user input when the switch assembly is received by the first switch receiver;

the second switch mount being configured to connect to a second type of firearm connection structure different from the first firearm connection structure, the second switch mount including a second switch receiver configured to receive the switch assembly, the second switch receiver including:

a second switch assembly receiving recess sized and shaped to receive the switch assembly; and a second top opening via which the switch actuator is accessible for receiving user input when the switch assembly is received by the second switch receiver.

2. The remote switch system of claim 1, wherein the first switch receiver is a one-piece component and the second switch receiver is a one-piece component.

3. The remote switch system of claim 1, wherein the switch assembly includes a tether for operatively connecting the switch assembly with the firearm accessory, wherein the first switch mount includes a first passage configured to permit the tether to pass from the first switch receiver to the firearm accessory when the switch assembly is received by the first switch receiver, and wherein the second switch mount includes a second passage configured to permit the tether to pass from the second switch receiver to the firearm accessory when the switch assembly is received by the second switch receiver.

4. The remote switch system of claim 1, wherein the first switch mount includes first and second firearm connectors configured to connect to a dovetail style rail, the firs switch mount being resiliently flexible to permit the first and second firearm connectors to connect to the dovetail style rail.

5. The remote switch system of claim 4, wherein each of the first and second firearm connectors comprises a jaw.

6. The remote switch system of claim 1, wherein the second switch mount includes a firearm connector configured to connect to a M-LOK style rail.

7. The remote switch system of claim 6, wherein the firearm connector includes a foot configured to be received in a slot of the M-LOK style rail, the foot arranged to underly the M-LOK style rail.

8. The remote switch system of claim 1, wherein the first switch mount is configured to form a first friction fit with the switch assembly when the switch assembly is received by the first switch receiver to hold the switch assembly in position with respect to the first switch mount, and wherein the second switch mount is configured to form a second friction fit with the switch assembly when the switch assembly is received by the second switch receiver to hold the switch assembly in position with respect to the second switch mount.

9. The remote switch system of claim 1, wherein the first top opening has a first perimeter, the entirety of the first perimeter being bounded by the first switch receiver, and wherein the second top opening has a second perimeter, the entirety of the second perimeter being bounded by the second switch receiver.

10. A remote switch for use with a firearm accessory on a firearm, the remote switch comprising:

a switch assembly including a switch housing, a switch supported by the switch housing, and a tether for operatively connecting the switch with the firearm accessory; and a switch mount configured to mount on the firearm, the switch mount being resiliently deformable to permit connection of the switch mount with the switch assembly by resilient deformation of the switch mount, the switch mount including a passage configured to permit the tether to pass to the firearm accessory when the switch assembly is connected to the switch mount, the switch mount being resiliently deformable to permit connection of the switch mount with the switch assembly by resilient deformation of the switch mount comprises the switch mount being resiliently deformable to permit placement of the tether in the passage.

11. The remote switch of claim 10, wherein the switch mount is formed separately from the switch assembly.

12. The remote switch of claim 10, wherein the switch assembly includes a switch actuator, and wherein the switch mount includes:

a switch assembly receiving recess sized and shaped to receive the switch assembly; and a top opening via which the switch actuator is accessible for receiving user input when the switch assembly is received in the switch assembly receiving recess.

13. The remote switch of claim 12, wherein the switch mount includes a bottom defining a bottom opening of the switch assembly receiving recess, the bottom opening being sized and shaped to permit the switch assembly to be inserted into the switch assembly receiving recess from the bottom of the switch mount.

14. The remote switch of claim 10, wherein the switch mount includes a slot leading to the passage, the switch mount being resiliently deformable to widen the slot to permit the tether to move through the slot and into the passage.

15. The remote switch of claim 14, wherein the slot is too narrow to permit the tether to move through the slot when the switch mount is in an undeformed at-rest state.

16. The remote switch of claim 14, wherein the switch mount includes a firearm connector configured to mount the switch mount on the firearm, wherein the firearm connector includes the slot.

17. The remote switch of claim 16, wherein the firearm connector is configured to mount to a rail of the firearm.

18. The remote switch of claim 17, wherein the firearm connector is configured to be received in a slot of the rail of the firearm.

19. The remote switch of claim 18, wherein the firearm connector includes a fastener opening configured to receive a fastener to secure the firearm connector to the rail of the firearm.

20. The remote switch of claim 16, wherein the slot extends through the fastener opening.

* * * * *